US010047416B2

(12) United States Patent
Kami et al.

(10) Patent No.: US 10,047,416 B2
(45) Date of Patent: Aug. 14, 2018

(54) HOT ROLLED STEEL SHEET AND METHOD FOR MANUFACTURING THE SAME

(71) Applicant: JFE STEEL CORPORATION, Tokyo (JP)

(72) Inventors: Chikara Kami, Chiba (JP); Sota Goto, Handa (JP)

(73) Assignee: JFE STEEL CORPORATION, Tokyo (JP)

( * ) Notice: Subject to any disclaimer, the term of this patent is extended or adjusted under 35 U.S.C. 154(b) by 555 days.

(21) Appl. No.: 14/427,822

(22) PCT Filed: Sep. 11, 2013

(86) PCT No.: PCT/JP2013/005387
§ 371 (c)(1),
(2) Date: Mar. 12, 2015

(87) PCT Pub. No.: WO2014/041801
PCT Pub. Date: Mar. 20, 2014

(65) Prior Publication Data

US 2015/0344998 A1 Dec. 3, 2015

(30) Foreign Application Priority Data

Sep. 13, 2012 (JP) ..... 2012-201262

(51) Int. Cl.

| | |
|---|---|
| ***C22C 38/04*** | (2006.01) |
| ***C21D 6/00*** | (2006.01) |
| ***C22C 38/00*** | (2006.01) |
| ***C21D 8/02*** | (2006.01) |
| ***C21D 9/46*** | (2006.01) |
| ***C22C 38/58*** | (2006.01) |
| ***C21D 8/12*** | (2006.01) |
| ***C22C 38/02*** | (2006.01) |
| ***C22C 38/06*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/54*** | (2006.01) |

(52) U.S. Cl.
CPC ..... *C22C 38/001* (2013.01); *C21D 6/004* (2013.01); *C21D 6/005* (2013.01); *C21D 6/008* (2013.01); *C21D 8/0226* (2013.01); *C21D 8/0263* (2013.01); *C21D 8/1222* (2013.01); *C21D 8/1261* (2013.01); *C21D 9/46* (2013.01); *C22C 38/002* (2013.01); *C22C 38/02* (2013.01); *C22C 38/04* (2013.01); *C22C 38/06* (2013.01); *C22C 38/42* (2013.01); *C22C 38/44* (2013.01); *C22C 38/46* (2013.01); *C22C 38/48* (2013.01); *C22C 38/50* (2013.01); *C22C 38/54* (2013.01); *C22C 38/58* (2013.01); *C21D 2211/002* (2013.01); *C21D 2211/008* (2013.01)

(58) Field of Classification Search
CPC ..... C21D 6/008
See application file for complete search history.

(56) References Cited

U.S. PATENT DOCUMENTS

| | | | | |
|---|---|---|---|---|
| 5,830,293 | A | 11/1998 | Meyer et al. | |
| 2010/0059149 | A1 | 3/2010 | Yokoi et al. | |
| 2010/0119860 | A1 | 5/2010 | Hitoshi et al. | |
| 2011/0073222 | A1 | 3/2011 | Strandell et al. | |
| 2011/0284137 | A1 | 11/2011 | Kami et al. | |
| 2014/0290807 | A1 | 10/2014 | Goto et al. | |
| 2015/0232970 | A1* | 8/2015 | Kami | C22C 38/58 148/506 |
| 2015/0344998 | A1 | 12/2015 | Kami et al. | |

FOREIGN PATENT DOCUMENTS

| | | | |
|---|---|---|---|
| CN | 102112643 | A | 6/2011 |
| CN | 102301026 | A | 12/2011 |
| EP | 2 309 014 | A1 | 4/2011 |
| EP | 2 392 681 | A1 | 12/2011 |
| EP | 2 392 682 | A1 | 12/2011 |
| EP | 2735622 | A1 | 5/2014 |
| JP | S63227715 | A | 9/1988 |
| JP | H10176239 | A | 6/1998 |
| JP | 2006299413 | A | 11/2006 |

(Continued)

OTHER PUBLICATIONS

English Translation of JP 2012-172256A published Sep. 10, 2012.*
Jan. 12, 2016 Office Action issued in Chinese Patent Application No. 201380047662.8.
Apr. 4, 2017 Office Action issued in European Patent Application No. 13836371.8.
Dec. 17, 2013 International Search Report issued in International Application No. PCT/JP2013/005387.
Dec. 17, 2013 Search Report issued in International Patent Application No. PCT/JP2013/005388.
Oct. 20, 2015 Search Report in European Patent Application No. 13837646.2.
Jan. 29, 2016 Office Action issued in Chinese Patent Application No. 201380047480.0.

(Continued)

*Primary Examiner* — Jessee R Roe
*Assistant Examiner* — Jophy S. Koshy
(74) *Attorney, Agent, or Firm* — Oliff PLC

(57) ABSTRACT

A high strength hot rolled steel sheet is provided with low yield ratio and that is excellent in low-temperature toughness. The hot rolled steel sheet can be used as a raw material of a steel pipe. The steel sheet has a chemical composition containing C: 0.03% or more and 0.10% or less, Si: 0.01% or more and 0.50% or less, Mn: 1.4% or more and 2.2% or less, P: 0.025% or less, S: 0.005% or less, Al: 0.005% or more and 0.10% or less, Nb: 0.02% or more and 0.10% or less, Ti: 0.001% or more and 0.030% or less, Mo: 0.01% or more and 0.50% or less, Cr: 0.01% or more and 0.50% or less, and Ni: 0.01% or more and 0.50% or less, in which the condition that Moeq is 1.4% or more and 2.2% or less.

8 Claims, 1 Drawing Sheet

(56) References Cited

FOREIGN PATENT DOCUMENTS

| | | | |
|---|---|---|---|
| JP | 2008248384 | A | 10/2008 |
| JP | 2010059472 | A | 3/2010 |
| JP | 2010196160 | A | 9/2010 |
| JP | 2010209471 | A | 9/2010 |
| JP | 2012172256 | A | 9/2012 |
| JP | 2013007101 | A | 1/2013 |

OTHER PUBLICATIONS

Apr. 7, 2017 Office Action issued in European Patent Application No. 13837646.2.
U.S. Appl. No. 14/428,217 in the name of Kami et al.
Dec. 6, 2017 Office Action issued in U.S. Appl. No. 14/428,217.
Apr. 11, 2018 Office Action issued in U.S. Appl. No. 14/428,217.

* cited by examiner

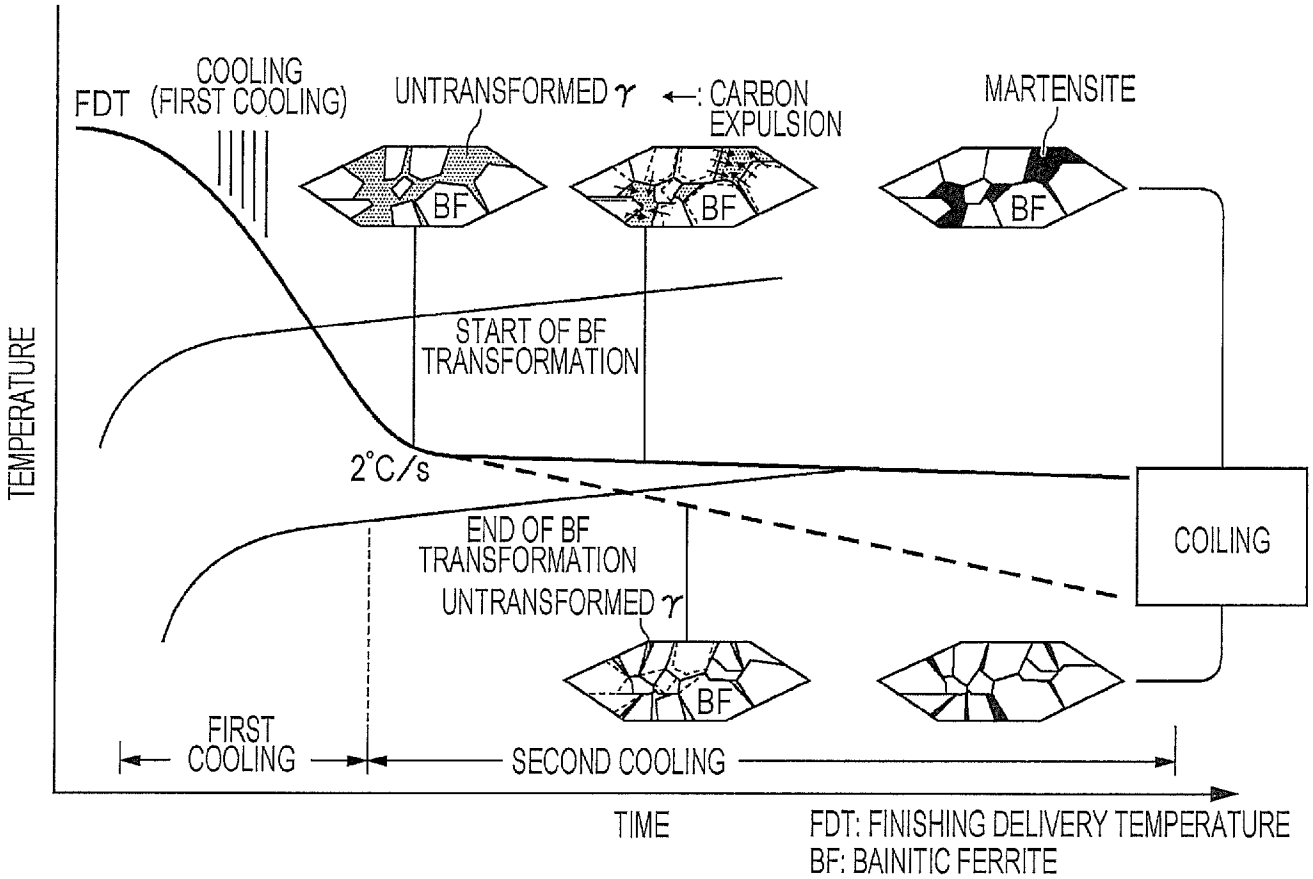
TEMPERATURE
FDT
COOLING (FIRST COOLING)
UNTRANSFORMED γ
BF
←: CARBON EXPULSION
MARTENSITE
START OF BF TRANSFORMATION
2°C/s
END OF BF TRANSFORMATION
UNTRANSFORMED γ
COILING
FIRST COOLING
SECOND COOLING
TIME
FDT: FINISHING DELIVERY TEMPERATURE
BF: BAINITIC FERRITE

HOT ROLLED STEEL SHEET AND METHOD FOR MANUFACTURING THE SAME

TECHNICAL FIELD

Embodiments of the present disclosure relate to a high strength hot rolled steel sheet with low yield ratio which can be preferably used as the raw material of a spiral steel pipe or an electric resistance welded (ERW) pipe used for a line pipe, and to a method for manufacturing the steel sheet. In particular, embodiments of the present disclosure relate to a method for stably achieving a low yield ratio and excellent low-temperature toughness while preventing a decrease in yield strength after pipe-making has been performed.

BACKGROUND ART

Nowadays, spiral steel pipes are being used increasingly for line pipes for transferring crude oil and natural gas, because steel pipes having a large diameter can be efficiently manufactured using a process in which pipe-making is performed by forming a steel sheet into a spiral configuration. In particular, pipe lines for a long-distance transportation are used under increased pressure due to a requirement for an increase in transportation efficiency and often run through cold districts because many oil wells and gas wells are situated in cold districts. Therefore, such line pipes to be used are required to have increased strength and toughness. Moreover, line pipes are required to have a low yield ratio from the viewpoint of buckling resistance and earthquake resistance. The yield ratio in the longitudinal direction of a spiral steel pipe is substantially equal to that of a hot rolled steel sheet which is a raw material of the spiral steel pipe, because a yield ratio is scarcely changed under a pipe-making process. Therefore, in order to decrease the yield ratio of a line pipe manufactured using a pipe-making process for a spiral steel pipe, it is necessary to decrease the yield ratio of a hot rolled steel sheet which is a raw material of the line pipe.

In order to meet such a requirement, for example, Patent Literature 1 discloses a method for manufacturing a high tensile strength hot rolled steel sheet for a line pipe with low yield ratio excellent in terms of low-temperature toughness. It is said that the technique described in Patent Literature 1 includes heating a steel slab having a chemical composition containing, by mass %, C: 0.03% to 0.12%, Si: 0.50% or less, Mn: 1.70% or less, Al: 0.070% or less, and at least one of Nb: 0.01% to 0.05%, V: 0.01% to 0.02%, and Ti: 0.01% to 0.20% at a temperature of 1180° C. to 1300° C., performing hot rolling on the heated slab under conditions that the roughing delivery temperature is 950° C. to 1050° C. and that the finishing delivery temperature is 760° C. to 800° C., cooling the hot rolled steel sheet at a cooling rate of 5 to 20° C./s, starting air cooling for a holding time of 5 to 20 seconds on the cooled steel sheet before the temperature of the cooled steel sheet reaches 670° C., cooling the air-cooled steel sheet at a cooling rate of 20° C./s or more, and coiling the cooled steel sheet at a temperature of 500° C. or lower in order to make a hot rolled steel sheet. According to the technique disclosed in Patent Literature 1, it is said that it is possible to manufacture a high-toughness hot rolled steel sheet having a tensile strength of 60 kg/mm$^2$ or more (590 MPa or more), a yield ratio of 85% or less, and a fracture transition temperature of −60° C. or lower.

In addition, Patent Literature 2 discloses a method for manufacturing a hot rolled steel sheet for a high strength pipe with low yield ratio. The technique described in Patent Literature 2 is a method for manufacturing a hot rolled steel sheet, the method including heating steel having a chemical composition containing C: 0.02% to 0.12%, Si: 0.1% to 1.5%, Mn: 2.0% or less, Al: 0.01% to 0.10%, and Mo+Cr: 0.1% to 1.5% at a temperature of 1000° C. to 1300° C., finishing hot rolling in a temperature range of 750° C. to 950° C., cooling the hot rolled steel sheet to a coiling temperature at a cooling rate of 10° C./s to 50° C./s, and coiling the steel sheet in a temperature range of 480° C. to 600° C. According to the technique disclosed in Patent Literature 2, it is said that it is possible, without performing rapid cooling from a temperature range in which an austenite phase is formed, to obtain a hot rolled steel sheet having a microstructure including a ferrite phase as a main phase, in terms of area fraction, 1 to 20% of a martensitic phase, a yield ratio of 85% or less, and a small decrease in yield strength after pipe-making has been performed.

In addition, Patent Literature 3 discloses a method for manufacturing an ERW pipe with low yield ratio excellent in terms of low-temperature toughness. According to the technique disclosed in Patent Literature 3, an ERW pipe is manufactured by hot rolling a slab having a chemical composition containing, by mass %, C: 0.01% to 0.09%, Si: 0.50% or less, Mn: 2.5% or less, Al: 0.01% to 0.10%, Nb: 0.005% to 0.10%, and one, two, or more of Mo: 0.5% or less, Cu: 0.5% or less, Ni: 0.5% or less, and Cr: 0.5% or less, in which Mneq, which is expressed by a relational expression regarding the contents of Mn, Si, P, Cr, Ni, and Mo, is 2.0 or more, by cooling the hot rolled steel sheet to a temperature of 500° C. to 650° C. at a cooling rate of 5° C./s or more, by coiling the cooled steel sheet, by holding the coiled steel sheet in this temperature range for 10 minutes or more, by cooling the held steel sheet to a temperature of lower than 500° C. in order to make a hot rolled steel sheet, and by performing pipe-making with the hot rolled steel sheet. According to the technique disclosed in Patent Literature 3, it is said that it is possible to manufacture an ERW pipe having a microstructure including a bainitic ferrite phase as a main phase, 3% or more of martensitic phase, and 1% or more of a retained austenite phase as needed, a fracture transition temperature of −50° C. or lower, excellent low-temperature toughness, and high plastic deformation absorption capability.

In addition, Patent Literature 4 discloses a high-toughness thick steel sheet with low yield ratio. According to the technique disclosed in Patent Literature 4, it is said that it is possible to obtain a high-toughness thick steel sheet with aow yield ratio having a mixed microstructure in which a ferrite phase having an average grain diameter of 10 to 50 μm and a bainite phase in which, in terms of area fraction, 1% to 20% of a martensite-austenite constituent is dispersed by heating a slab having a chemical composition containing C: 0.03% to 0.15%, Si: 1.0% or less, Mn: 1.0% to 2.0%, Al: 0.005% to 0.060%, Ti: 0.008% to 0.030%, N: 0.0020% to 0.010%, and O: 0.010% or less, preferably at a temperature of 950° C. to 1300° C., by performing hot rolling on the heated slab under conditions that the rolling reduction in a temperature range of (the Ar3 transformation point+100° C.) to (the Ar3 transformation point+150° C.) is 10% or more and where the finishing delivery temperature is 800° C. to 700° C., by starting accelerated cooling on the hot rolled steel sheet at a temperature within −50° C. from the finishing delivery temperature, by performing cooling with water to a temperature of 400° C. to 150° C. at an average cooling rate of 5° C./s to 50° C./s, and by performing air cooling thereafter. Here, there is no mention of the shape of a martensite-austenite constituent (rod-like or massive: described below).

CITATION LIST

Patent Literature

PTL 1: Japanese Unexamined Patent Application Publication No. 63-227715

PTL 2: Japanese Unexamined Patent Application Publication No. 10-176239

PTL 3: Japanese Unexamined Patent Application Publication No. 2006-299413

PTL 4: Japanese Unexamined Patent Application Publication No. 2010-59472

SUMMARY OF INVENTION

Technical Problem

However, in the case of the technique described in Patent Literature 1, since a cooling rate is excessively high before and after air cooling is performed, in particular, after air cooling has been performed, it is necessary to control quickly and appropriately a cooling rate, a cooling stop temperature and the like. In particular, there is a problem in that a large-scale cooling equipment is necessary in order to manufacture a thick hot rolled steel sheet. In addition, since a hot rolled steel sheet obtained by using the technique described in Patent Literature 1 has a microstructure including mainly a soft polygonal ferrite, there is a problem in that it is difficult to achieve desired high strength.

In addition, in the case of the technique described in Patent Literature 2, since there is still a decrease in yield strength after pipe-making has been performed, there is a case where a recent requirement for an increase in the strength of a steel pipe cannot be satisfied.

In addition, in case of the technique described in Patent Literature 3, there is a problem in that the technique has not reached a level high enough to stably achieve, in terms of fracture transition temperature vTrs, an excellent low-temperature toughness of −80° C. or lower which indicates a cold district specification nowadays.

In the case of a thick steel sheet obtained using the technique described in Patent Literature 4, since, in terms of sheared area transition temperature vTrs, only a low toughness of about −30° C. to −41° C. is achieved at most, there is a problem in that it is impossible to meet a recent requirement for an increase in toughness more than ever.

In addition, due to a recent requirement of transporting, for example, crude oil with high efficiency, a raw material of a steel pipe having high strength and a large thickness is required. However, there are problems in that there is an increase in the amounts of alloying elements in order to increase strength and in that it is necessary to perform rapid cooling in a process for manufacturing a hot rolled steel sheet due to an increase in thickness. Since a hot rolled steel sheet is transferred at a high speed through a water-cooling zone having a limited length and wound in a coiled shape, it is necessary to perform stronger cooling for a larger thickness. Therefore, there is a problem in that there is an increase in surface hardness of a steel sheet more than necessary.

In particular, for example, in the case where a hot rolled steel sheet having a large thickness of 10 mm or more is manufactured, since a sheet passing speed of finishing rolling is as high as 100 to 250 mpm, a hot rolled steel sheet is also transferred at a high speed through a cooling/zone after finishing rolling has been performed. Therefore, cooling is performed with a larger heat transfer coefficient for a larger thickness. Therefore, since there is an increase in the surface hardness of a hot rolled steel sheet more than necessary, there are problems in that there is an increase in the hardness of the surface of a hot rolled steel sheet compared with the inner part in the thickness of the steel sheet and, further, in that the distribution of surface hardness often becomes non-uniform. There is also a problem in that such non-uniform distribution of hardness causes variations in the properties of a steel pipe.

An object embodiments is, by solving the problems regarding conventional techniques described above, to provide a high strength hot rolled steel sheet with low yield ratio excellent in terms of low-temperature toughness which can be preferably used as a raw material of a steel pipe, in particular, of a spiral steel pipe, and with which a decrease in strength after spiral pipe-making has been performed is prevented without performing a complex heat treatment and without performing major equipment modification. In particular, an object of embodiments is to provide a high strength hot rolled steel sheet with low yield ratio excellent in terms of low-temperature toughness having a thickness of 8 mm or more (preferably 10 mm or more) and 50 mm or less (preferably 25 mm or less). Here, "high strength" refers to a case where yield strength in a direction at an angle of 30 degrees to the rolling direction is 480 MPa or more and tensile strength in the width direction is 600 MPa or more, "excellent in terms of low-temperature toughness" refers to a case where a fracture transition temperature vTrs in a Charpy impact test is −80° C. or lower, and "low yield ratio" refers to a case where a steel sheet has a stress-strain curve of a continuous yielding type and a yield ratio of 85% or less. In addition, the meaning of "steel sheet" includes a steel sheet and a steel strip.

Solution to Problem

The present inventors, in order to achieve the object described above, diligently conducted investigations regarding various factors having influences on the strength and toughness of a steel pipe after pipe-making has been performed, and as a result, found that a decrease in strength after pipe-making has been performed is caused by a decrease in yield strength due to a Bauschinger effect occurring on the inner surface side of a pipe to which compressive stress is applied and by the elimination of yield elongation occurring on the outer surface side of a pipe to which tensile stress is applied.

Therefore, the present inventors conducted further investigations, and as a result, found that, by forming a microstructure of a steel sheet including a fine bainitic ferrite phase as a main phase and by finely dispersing a hard massive martensite in the bainitic ferrite phase, it is possible to prevent a decrease in strength after pipe-making, in particular, spiral pipe-making has been performed and it is possible to obtain a steel pipe having a yield ratio of 85% or less and excellent toughness at the same time. That is because, by forming such a microstructure, since there is an increase in the work-hardening capability of a steel sheet which is the raw material of a steel pipe, there is a sufficient increase in strength due to work-hardening occurring on the outer surface side of a pipe when pipe-making is performed, which results in a decrease in strength after pipe-making, in particular, spiral pipe-making has been performed being prevented. Moreover, it was found that, by finely dispersing a massive martensitic phase, there is a significant increase in toughness. Moreover, it was also found that it is particularly effective to control the lath thickness of a bainitic ferrite phase in a surface layer in order to achieve an excellent pipe shape and uniform deformation capability after forming has been performed by preventing a non-uniform increase in surface hardness.

Embodiments of the present disclosure have been completed on the basis of the knowledge described above and further investigations.

(1) A hot rolled steel sheet, the steel sheet having a chemical composition containing, by mass %, C: 0.03% or more and 0.10% or less, Si: 0.01% or more and 0.50% or less, Mn: 1.4% or more and 2.2% or less, P: 0.025% or less, S: 0.005% or less, Al: 0.005% or more and 0.10% or less, Nb: 0.02% or more and 0.10% or less, Ti: 0.001% or more and 0.030% or less, Mo: 0.01% or more and 0.50% or less, Cr: 0.01% or more and 0.50% or less, Ni: 0.01% or more and 0.50% or less, and the balance being Fe and inevitable impurities, a microstructure in a surface layer including a bainitic ferrite phase or a bainitic ferrite phase and a tempered martensitic phase, in which the lath thickness of the bainitic ferrite phase is 0.2 μm or more and 1.6 μm or less, and a microstructure in an inner layer including a bainitic ferrite phase as a main phase and, in terms of area fraction, 1.4% or more and 15% or less of a massive martensitic phase having an aspect ratio of less than 5.0 as a second phase, in which the lath thickness of the bainitic ferrite phase of the inner layer is 0.2 μm or more and 1.6 μm or less.

(2) The hot rolled steel sheet according to item (1), in which the chemical composition satisfies the condition where Moeq, which is defined by equation (1) below, is, by mass %, 1.4% or more and 2.2% or less:

$$\text{Moeq (\%)}=\text{Mo}+0.36\text{Cr}+0.77\text{Mn}+0.07\text{Ni} \quad (1),$$

(where, Mn, Ni, Cr, and Mo respectively represent the contents (mass %) of the corresponding chemical elements)

(3) The hot rolled steel sheet according to item (1) or (2), the steel sheet having the chemical composition further containing, by mass %, one, two, or all selected from among Cu: 0.50% or less, V: 0.10% or less, and B: 0.0005% or less.

(4) The hot rolled steel sheet according to any one of items (1) to (3), the steel sheet having the chemical composition further containing, by mass %, Ca: 0.0005% or more and 0.0050% or less.

(5) The hot rolled steel sheet according to any one of items (1) to (4), in which the size of the massive martensitic phase is 5.0 μm or less at most and 0.5 μm or more and 3.0 μm or less on average.

(6) The hot rolled steel sheet according to any one of items (1) to (5), in which the grain diameter of the tempered martensitic phase in the surface layer is 3.0 μm or less on average and 4.0 μm or less at most.

(7) A method for manufacturing a hot rolled steel sheet, in which a processing operation using a hot rolling process, a cooling process, and a coiling process is performed on a steel material in order to manufacture a hot rolled steel sheet, the method including using a steel material having a chemical composition containing, by mass %, C: 0.03% or more and 0.10% or less, Si: 0.01% or more and 0.50% or less, Mn: 1.4% or more and 2.2% or less, P: 0.025% or less, S: 0.005% or less, Al: 0.005% or more and 0.10% or less, Nb: 0.02% or more and 0.10% or less, Ti: 0.001% or more and 0.030% or less, Mo: 0.01% or more and 0.50% or less, Cr: 0.01% or more and 0.50% or less, Ni: 0.01% or more and 0.50% or less, and the balance being Fe and inevitable impurities as the steel material, using the hot rolling process in a manner such that the steel material is made into a hot rolled steel sheet by heating the steel material at a heating temperature of 1050° C. or higher and 1300° C. or lower, by performing roughing rolling on the heated steel material in order to make a transfer bar, and by performing finishing rolling on the transfer bar so that the cumulative reduction in a temperature range of 930° C. or lower is 50% or more, using the cooling process in a manner such that the cooling process consists of a first cooling, in which cooling is started immediately after finishing rolling has been performed, in which cooling is performed, in terms of temperature in the central part of the thickness, at an average cooling rate of 5° C./s or more and 30° C./s or less in a temperature range of 750° C. or lower and 600° C. or higher, and in which cooling is stopped at a cooling stop temperature in a temperature range of 600° C. or lower and 450° C. or higher, and a second cooling, in which cooling is performed, in terms of temperature in the central part of the thickness, at an average cooling rate of 2° C./s or less from the cooling stop temperature of the first cooling to a coiling temperature, or in which the hot rolled steel sheet is held in a temperature range from the cooling stop temperature of the first cooling to a coiling temperature for 20 seconds or more, and that the first cooling is performed, in terms of surface temperature, at an average cooling rate of 100° C./s or less in a temperature range of 600° C. or lower and 450° C. or higher and stopped at a temperature of (the Ms transformation point −20° C.) or higher in terms of surface temperature, and using the coiling process in such a manner that a coiling temperature is 450° C. or more in terms of surface temperature.

(8) The method for manufacturing a hot rolled steel sheet according to item (7), in which the chemical composition satisfies the condition where Moeq, which is defined by equation (1) below, is, by mass %, 1.4% or more and 2.2% or less:

$$\text{Moeq (\%)}=\text{Mo}+0.36\text{Cr}+0.77\text{Mn}+0.07\text{Ni} \quad (1),$$

(where, Mn, Ni, Cr, and Mo respectively represent the contents (mass %) of the corresponding chemical elements)

(9) The method for manufacturing a hot rolled steel sheet according to item (7) or (8), the method including using a steel material having the chemical composition further containing, by mass %, one, two, or all selected from among Cu: 0.50% or less, V: 0.10% or less, and B: 0.0005% or less.

(10) The method for manufacturing a hot rolled steel sheet according to any one of items (7) to (9), the method including using a steel material having the chemical composition further containing, by mass %, Ca: 0.0005% or more and 0.0050% or less.

Advantageous Effects of Invention

According to embodiments, obtained is a high strength hot rolled steel sheet with low yield ratio excellent in terms of low-temperature toughness having a yield stress in a direction at an angle of 30 degrees to the rolling direction of 480 MPa or more, a tensile strength in the width direction of 600 MPa or more, a fracture transit temperature vTrs of −80° C. or lower in a Charpy impact test, and a yield ratio of 85% or less which can be preferably used as, in particular, a raw material of a spiral steel pipe, which is excellent in terms of uniform deformation capability during a pipe-making process, with which there is only a small decrease in strength after pipe-making has been performed, and which is excellent in terms of pipe shape after pipe-making has been performed. In addition, the high strength hot rolled steel sheet with low yield ratio according to embodiments can be manufactured without performing a special heat treatment, with ease, and at low cost. As described above, embodiments of the present disclosure realize a significant effect in industry. In addition, according to embodiments, it is possible to inexpensively and easily manufacture line pipes which are laid using a reel barge method and ERW pipes for line pipes which are required to have earthquake resistance. In addition, in the case where the high strength hot rolled steel sheet with low yield ratio according to embodiments is used as a raw material, it is possible to manufacture a high strength spiral steel pipe pile which is used as an architectural member and a harbor structural member which are excellent in terms of earthquake resistance. In addition, since a spiral steel pipe which is made from such a hot rolled steel sheet has a low yield ratio in the longitudinal direction of the pipe, the spiral steel pipe can also be applied to a high-value added high strength steel pipe pile.

BRIEF DESCRIPTION OF DRAWINGS

FIG. 1 is a schematic diagram illustrating the relationship between the formation of a massive martensitic phase and second cooling which is performed in a cooling process after hot rolling has been performed.

DESCRIPTION OF EMBODIMENTS

First, the reason for the limitations on the chemical composition of the hot rolled steel sheet according to embodiments of the present disclosure will be described. Hereinafter, mass % is simply represented by %, unless otherwise noted.

C: 0.03% or More and 0.10% or Less

C is precipitated in the form of a carbide and contributes to an increase in the strength of steel sheet through precipitation strengthening. C is also a chemical element which contributes to an increase in the toughness of a steel sheet by decreasing a crystal grain diameter. Moreover, C is effective for promoting the formation of an untransformed austenite phase by stabilizing an austenite phase as a result of forming a solid solution in austenite. In order to realize such effects, it is necessary that the C content be 0.03% or more. On the other hand, in the case where the C content is more than 0.10%, since there is an increased tendency for a cementite phase having a large grain diameter to be formed at crystal grain boundaries, there is a decrease in toughness. Therefore, the C content is limited to 0.03% or more and 0.10% or less, preferably 0.04% or more and 0.09% or less.

Si: 0.01% or More and 0.50% or Less

Si contributes to an increase in the strength of a steel sheet through solid solution strengthening. Also, Si contributes to a decrease in yield ratio by forming a hard second phase (for example, martensitic phase). In order to realize such effects, it is necessary that the Si content be 0.01% or more. On the other hand, in the case where the Si content is more than 0.50%, since a significant amount of oxide scale containing fayalite is formed, there is a decrease in the appearance quality of a steel sheet. Therefore, the Si content is limited to 0.01% or more and 0.50% or less, preferably 0.20% or more and 0.40% or less.

Mn: 1.4% or More and 2.2% or Less

Mn promotes the formation of a martensitic phase by increasing the hardenability of steel as a result of forming a solid solution. Also, Mn is a chemical element which contributes to an increase in the toughness of a steel sheet by decreasing the grain diameter of a microstructure as a result of decreasing a temperature at which bainitic ferrite transformation starts. In order to realize such effects, it is necessary that the Mn content be 1.4% or more. On the other hand, in the case where the Mn content is more than 2.2%, there is a decrease in the toughness of a heat affected zone. Therefore, the Mn content is limited to 1.4% or more and 2.2% or less, preferably 1.6% or more and 2.0% or less from the viewpoint of the stable formation of a massive martensitic phase.

P: 0.025% or Less

P contributes to an increase in the strength of a steel sheet as a result of forming a solid solution, but P decreases toughness at the same time. Therefore, according to embodiments, it is preferable that P be treated as an impurity and the P content be as small as possible. However, it is acceptable that the P content be 0.025% or less, preferably 0.015% or less. Since there is an increase in refining cost in the case where the P content is excessively small, it is preferable that the P content be about 0.001% or more.

S: 0.005% or Less

S causes the fracture of, for example, a slab by forming sulfide-based inclusions having a large grain diameter such as MnS in steel. Also, S decreases the ductility of a steel sheet. These phenomena become significant in the case where the S content is more than 0.005%. Therefore, the S content is limited to 0.005% or less, preferably 0.004% or less. Although there is no problem even in the case where the S content is 0%, since there is an increase in refining cost in the case where the S content is excessively small, it is preferable that the S content be about 0.0001% or more.

Al: 0.005% or More and 0.10% or Less

Al functions as a deoxidizing agent. Also, Al is a chemical element which is effective for fixing N which causes strain aging. In order to realize such effects, it is necessary that the Al content be 0.005% or more. On the other hand, in the case where the Al content is more than 0.10%, since there is an increase in the amount of oxides in steel, there is a decrease in the toughness of a base metal and a weld zone. In addition, since a nitride layer tends to be formed in the surface layer of a steel material such as a slab or a steel sheet when the steel material or the steel sheet are heated in a heating furnace, there may be an increase in yield ratio. Therefore, the Al content is limited to 0.005% or more and 0.10% or less, preferably 0.08% or less.

Nb: 0.02% or More and 0.10% or Less

Since Nb is effective for preventing an austenite grain diameter from excessively increasing and for preventing the recrystallization of austenite grains as a result of forming a solid solution in steel or being precipitated in the form of a carbonitride, Nb makes it possible to perform rolling in an un-recrystallization temperature range for an austenite phase. Also, Nb is a chemical element which contributes to an increase in the strength of a steel sheet as a result of being finely precipitated in the form of a carbide or a carbonitride. When cooling is performed after hot rolling has been performed, since Nb promotes the formation of a bainitic ferrite phase in a crystal grain by functioning as a $\gamma$ to $\alpha$ transformation nucleation site as a result of being precipitated in the form of a carbide or a carbonitride on a dislocation formed by performing hot rolling, Nb contributes to the formation of a fine massive untransformed austenite phase, and therefore contributes to the formation of a fine massive martensitic phase. In order to realize such effects, it is necessary that the Nb content be 0.02% or more. On the other hand, in the case where the Nb content is more than 0.10%, since there is an increase in resistance to deformation when hot rolling is performed, there is concern that it is difficult to perform hot rolling. Also, since there is an increase in the yield strength of a bainitic ferrite phase which is a main phase in the case where the Nb content is more than 0.10%, it is difficult to achieve a yield ratio of 85% or less. Therefore, the Nb content is limited to 0.02% or more and 0.10% or less, preferably 0.03% or more and 0.07% or less.

Ti: 0.001% or More and 0.030% or Less

Ti contributes to preventing fracture of a slab by fixing N in the form of a nitride. Also, Ti is effective for increasing the strength of a steel sheet as a result of being finely precipitated in the form of a carbide. In order to realize such effects, it is necessary that the Ti content be 0.001% or more. On the other hand, in the case where the Ti content is more than 0.030%, since there is an excessive increase in the bainitic ferrite transformation temperature, there is a decrease in the toughness of a steel sheet. Therefore, the Ti content is limited to 0.001% or more and 0.030% or less, preferably 0.005% or more and 0.025% or less.

Mo: 0.01% or More and 0.50% or Less

Mo contributes to an increase in hardenability and is effective for promoting the formation of a martensitic phase as a result of increasing the hardenability of an untransformed austenite phase by pulling C in a bainitic ferrite phase into an untransformed austenite phase. Moreover, Mo is a chemical element which contributes to an increase in the strength of a steel sheet through solid solution strengthening by forming a solid solution in steel. In order to realize such effects, it is necessary that the Mo content be 0.01% or more. On the other hand, in the case where the Mo content is more than 0.50%, since an excessive amount of a martensite is formed, there is a decrease in the toughness of a steel sheet. In addition, since Mo is an expensive chemical element, there is an increase in material cost in the case where the Mo content is large. Therefore, the Mo content is limited to 0.01% or more and 0.50% or less, preferably 0.10% or more and 0.40% or less.

Cr: 0.01% or More and 0.50% or Less

Cr delays $\gamma$ to $\alpha$ transformation, contributes to an increase in hardenability, and is effective for promoting the formation of a martensitic phase. In order to realize such effects, it is necessary that the Cr content be 0.01% or more. On the other hand, in the case where the Cr content is more than 0.50%, there is a tendency for many defects to occur in a weld zone. Therefore, the Cr content is limited to 0.01% or more and 0.50% or less, preferably 0.20% or more and 0.45% or less.

Ni: 0.01% or More and 0.50% or Less

Ni contributes to an increase in hardenability and promotes the formation of a martensitic phase, and in addition, is a chemical element which contributes to an increase in toughness. In order to realize such effects, it is necessary that the Ni content be 0.01% or more. On the other hand, in the case where the Ni content is more than 0.50%, since the effects become saturated, the effects corresponding to the Ni content cannot be expected, which results in economic disadvantage. Therefore, the Ni content is limited to 0.01% or more and 0.50% or less, preferably 0.30% or more and 0.45% or less.

The chemical composition described above is a basic chemical composition, and, in embodiments, it is preferable that the chemical composition be controlled so as to satisfy the condition where Moeq, which is defined by equation (1) below, is 1.4% or more and 2.2% or less.

$$\text{Moeq}\ (\%)=\text{Mo}+0.36\text{Cr}+0.77\text{Mn}+0.07\text{Ni} \quad (1),$$

(where, Mn, Ni, Cr, and Mo respectively represent the contents (mass %) of the corresponding chemical elements)

Moeq is an index of the hardenability of an untransformed austenite phase which is retained by a steel sheet after the steel sheet has been subjected to a processing operation using a cooling process. In the case where Moeq is less than 1.4%, since an untransformed austenite phase has insufficient hardenability, the untransformed austenite phase transforms into, for example, a pearlite phase in a coiling process thereafter. On the other hand, in the case where Moeq is more than 2.2%, since the amount of a martensitic phase formed becomes larger than necessary, there is a decrease in toughness. Therefore, it is preferable that Moeq be limited to 1.4% or more and 2.2% or less. In the case where Moeq is 1.5% or more, since a low yield ratio is achieved, there is a further increase in formability. Therefore, it is preferable that Moeq be 1.5% or more.

In embodiments of the present disclosure, while a chemical composition is within the range described above, as occasion calls, the chemical composition may further contain one, two, or all selected from among Cu: 0.50% or less, V: 0.10% or less, and B: 0.0005% or less and/or Ca: 0.0005% or more and 0.0050% or less as selective chemical elements.

One, Two, or all Selected from Among Cu: 0.50% or Less, V: 0.10% or Less, and B: 0.0005% or Less Since Cu, V, and B are all chemical elements which contribute to an increase in the strength of a steel sheet, these chemical elements may be selectively added as needed.

V and Cu contribute to an increase in the strength of a steel sheet through solid solution strengthening or precipitation strengthening. In addition, B contributes to an increase in the strength of a steel sheet by increasing hardenability as a result of being segregated at crystal grain boundaries. In order to realize such effects, it is preferable that the contents of Cu, V, and B be respectively 0.01% or more, 0.01% or more, and 0.0001% or more. On the other hand, in the case where the Cu content is more than 0.50%, there is a decrease in hot formability. In the case where the V content is more than 0.10%, there is a decrease in weldability. In the case where the B content is more than 0.0005%, there is a decrease in the toughness of a steel sheet. Therefore, in the case where Cu, V, and B are added, it is preferable that the contents of Cu, V, and B be respectively 0.50% or less, 0.10% or less, and 0.0005% or less.

Ca: 0.0005% or More and 0.0050% or Less

Since Ca is a chemical element which contributes to the control of the shape of a sulfide by making a sulfide having a large grain diameter into a sulfide having a spherical shape, Ca may be added as needed. In order to realize such an effect, it is preferable that the Ca content be 0.0005% or more. On the other hand, in the case where the Ca content is more than 0.0050%, there is a decrease in the cleanliness of a steel sheet. Therefore, in the case where Ca is added, it is preferable that the Ca content be limited to 0.0005% or more and 0.0050% or less.

The balance of the chemical composition consists of Fe and inevitable impurities. Among inevitable impurities, N: 0.005% or less, O: 0.005% or less, Mg: 0.003% or less, and Sn: 0.005% or less are acceptable.

Subsequently, the reason for the limitations on the microstructure of the high strength hot rolled steel sheet with low yield ratio according to embodiments will be described.

The high strength hot rolled steel sheet with low yield ratio according to embodiments has the chemical composition described above, and further, the microstructures of a layer on the surface side in the thickness direction (hereinafter, also simply called a surface layer) and a layer on the inner side in the thickness direction (hereinafter, also simply called an inner layer) are different from each other. Here, "a layer on the surface side in the thickness direction (surface layer)" refers to a region which is within a depth of less than 2 mm in the thickness direction from the upper or lower surface of a steel sheet. In addition, "a layer on the inner side in the thickness direction (inner layer)" refers to a region which is on the inner side at a depth of 2 mm or more in the thickness direction from the upper and lower surfaces of a steel sheet.

The layers on the surface side in the thickness direction (surface layer) have a microstructure which is composed of a bainitic ferrite phase or a bainitic ferrite phase and a tempered martensitic phase and in which the lath thickness of a bainitic ferrite phase is 0.2 μm or more and 1.6 μm or less. Here, "bainitic ferrite" is a phase which has a substructure having high dislocation density, and the meaning of "bainitic ferrite" includes needle-shaped ferrite and acicular ferrite. Here, the meaning of "bainitic ferrite" does not include polygonal ferrite, which has very low dislocation density, or quasi-polygonal ferrite, which is accompanied by a substructure such as a fine subgrain. By forming such a microstructure, excellent uniform formability can be provided. Since pipe forming is a process using bending deformation, the larger the distance from the center of the thickness, the larger the forming deformation in the thickness direction becomes, and in addition, the larger the thickness, the larger the deformation becomes. Therefore, it is important to control a microstructure in the surface layer.

In addition, in the case where the lath thickness of a bainitic ferrite phase in the surface layer is less than 0.2 μm, since there is an excessive increase in hardness due to high dislocation density, a pipe shape defect and a crack occur when pipe forming is performed, which results in special care being required. On the other hand, in the case where the lath thickness is more than 1.6 μm, it is difficult to achieve the desired high strength due to low dislocation density, resulting in a variation in strength. Therefore, the lath thickness of a bainitic ferrite phase in the surface layer is limited to 0.2 μm or more and 1.6 μm or less. Here, a lath thickness can be determined by viewing a lath in a right lateral direction using the method described in EXAMPLES below. It is preferable that the microstructure of the surface layer be substantively composed of a single phase including 98% or more of a fraction of a bainitic ferrite phase and 2% or less of a tempered martensitic phase in terms of area fraction. In the case where the area fraction of a tempered martensitic phase is more than 2%, since there is an increase in the hardness of the cross section of the surface layer, the surface layer is hardened compared with the inner layer, and in addition, non-uniform distribution of hardness tends to occur in many cases. It is preferable that the average grain diameter of a tempered martensitic phase be 3.0 μm or less. In the case where the average grain diameter is more than 3.0 μm, non-uniform distribution of hardness may occur in the surface layer. Moreover, it is preferable that the maximum grain diameter of a tempered martensitic phase be 4.0 μm or less. In the case where the maximum grain diameter is more than 4.0 μm, a variation in hardness tends to occur in the surface layer, and a negative effect on a pipe shape after pipe-making tends to occur. Therefore, it is preferable that the maximum grain diameter of a tempered martensitic phase be 4.0 μm or less and that a martensitic phase be uniformly dispersed. Here, the microstructure described above can be obtained by controlling manufacturing conditions, in particular, by performing finishing rolling so that the cumulative reduction in a temperature range of 930° C. or lower is 50% or more, performing a processing operation in the cooling process after the finishing rolling has been performed in a manner such that the cooling process consists of a first cooling, in which cooling is performed, in terms of temperature in the central part of the thickness, at an average cooling rate of 5° C./s or more and 30° C./s or less in a temperature range of 750° C. or lower and 600° C. or higher, and in which cooling is stopped at a cooling stop temperature of 600° C. or lower and 450° C. or higher, and a second cooling, in which cooling is performed, in terms of temperature in the central part of the thickness, at an average cooling rate of 2° C./s or less from the cooling stop temperature of the first cooling to a coiling temperature, or in which the hot rolled steel sheet is held in a temperature range from the cooling stop temperature of the first cooling to a coiling temperature for 20 seconds or more, and where the first cooling is performed, in terms of surface temperature, at an average cooling rate of 100° C./s or less in a temperature range of 600° C. or lower and 450° C. or higher and stopped at a temperature of (the Ms transformation point −20° C.) or higher in terms of surface temperature. In addition, the average grain diameter and the maximum grain diameter can be determined by using the methods described in the EXAMPLES below. In addition, the microstructure of the surface layer is different from that of the inner layer described below.

The layer on the inner side in the direction of the thickness (inner layer) has a microstructure which is composed of a main phase and a second phase while the first phase is a bainitic ferrite phase. Here, "a main phase" refers to a phase having an area fraction of 50% or more in terms area fraction. It is preferable that fine carbonitrides be precipitated in a bainitic ferrite phase which is the main phase in order to achieve the desired high strength.

A bainitic ferrite phase which is the main phase is characterized as having a lath thickness of 0.2 μm or more and 1.6 μm or less. In the case where the lath thickness is less than 0.2 μm, since there is an excessive increase in hardness due to high dislocation density, a movable dislocation which is formed by strain induced around a massive martensitic phase does not sufficiently function, which results in a tendency for a decrease in yield ratio to be obstructed. On the other hand, in the case where the lath thickness is more than 1.6 μm, it is difficult to achieve the desired high strength due to low dislocation density, resulting in a variation in strength. Therefore, the lath thickness of a bainitic ferrite phase in the inner layer is limited to 0.2 μm or more and 1.6 μm or less.

It is preferable that the average grain diameter of a bainitic ferrite phase which is the main phase be 10 μm or less. This decreases a variation in toughness. In the case where the average grain diameter of a bainitic ferrite phase is more than 10 μm, since grains having a small diameter and grains having a large diameter are mixed, low-temperature toughness tends to vary.

The second phase in the inner layer is a massive martensitic phase having an area fraction of 1.4% or more and 15% or less and an aspect ratio of less than 5.0. Here, "a massive martensitic phase" refers to a martensitic phase which is formed from untransformed austenite phase at prior-γ grain boundaries or inside prior-γ grains in a cooling process after rolling has been performed. In embodiments, such a massive martensitic phase is dispersed at prior-γ grain boundaries or at the grain boundaries between bainitic ferrite grains which are the main phase. A martensitic phase is harder than the main phase and is able to form a large amount of movable dislocations in a bainitic ferrite phase when forming is performed, and therefore, is able to provide yielding behavior of a continuous yielding type. In addition, since a martensitic phase has a higher tensile strength than a bainitic ferrite phase, a low yield ratio can be achieved. In addition, by controlling a martensitic phase to be a massive martensitic phase having an aspect ratio of less than 5.0, an increased amount of movable dislocations can be formed in the surrounding bainitic ferrite phase, which is effective for increasing deformation capability. In the case where the aspect ratio of a martensitic phase is 5.0 or more, since the martensitic phase becomes a rod-like martensitic phase (non-massive martensitic phase), the desired low yield ratio cannot be achieved, but it is acceptable that the amount of a rod-like martensitic phase is less than 30% in terms of area fraction with respect to the total amount of a martensitic phase. It is preferable that the amount of a massive martensitic phase be 70% or more in terms of area fraction with respect to the total amount of a martensitic phase. Here, an aspect ratio can be determined using the method described in EXAMPLES below.

In the inner layer, in terms of area fraction, 1.4% or more and 15% or less of a massive martensitic phase is dispersed as a second phase. In the case where the area fraction of a massive martensitic phase is less than 1.4%, it is difficult to achieve the desired low yield ratio. On the other hand, in the case where the area fraction of a massive martensitic phase is more than 15%, there is a significant decrease in low-temperature toughness. Therefore, the area fraction of a massive martensitic phase is limited to 1.4% or more and 15% or less, preferably 10% or less. Here, an area fraction can be determined using the method described in EXAMPLES below. In addition, it is preferable that the maximum size of a massive martensitic phase be 5.0 μm or less and that the average size of a massive martensitic phase be 0.5 μm or more and 3.0 μm or less. In the case where the average size of a massive martensitic phase is more than 3.0 μm, since the massive martensitic phase tends to become the origin of a brittle fracture or to promote the propagation of a crack, there is a decrease in low-temperature toughness. In addition, in the case where the average size of a massive martensitic phase is less than 0.5 μm, since the grain is excessively small, there is a decrease in the amount of movable dislocations formed in the surrounding bainitic ferrite phase. In addition, in the case where the maximum size of a massive martensitic phase is more than 5.0 μm, there is a decrease in toughness. Therefore, it is preferable that the maximum size of a massive martensitic phase be 5.0 μm or less and that the average size of a massive martensite be 0.5 μm or more and 3.0 μm or less. The size is expressed in terms of "diameter" which is defined as the sum of a long-side length and a short-side length divided by 2. The maximum value of the "diameters" is defined as the "maximum size" of a massive martensitic phase, and the arithmetic average of the "diameters" of all the grains obtained is defined as the "average size" of a massive martensitic phase. Here, the number of grains of a martensitic phase whose sizes are determined is 100 or more.

Here, the microstructure described above can be obtained by controlling manufacturing conditions, in particular, by performing finishing rolling so that the cumulative reduction in a temperature range of 930° C. or lower is 50% or more, performing a processing operation in the cooling process after the finishing rolling has been performed in a manner such that the cooling process consists of a first cooling, in which cooling is performed, in terms of temperature in the central part of the thickness, at an average cooling rate of 5° C./s or more and 30° C./s or less in a temperature range of 750° C. or lower and 600° C. or higher, and in which cooling is stopped at a cooling stop temperature of 600° C. or lower and 450° C. or higher, and a second cooling, in which cooling is performed, in terms of temperature in the central part of the thickness, at an average cooling rate of 2° C./s or less from the cooling stop temperature of the first cooling to a coiling temperature, or in which the hot rolled steel sheet is held in a temperature range from the cooling stop temperature of the first cooling to a coiling temperature for 20 seconds or more, and where the first cooling is performed, in terms of surface temperature, at an average cooling rate of 100° C./s or less in a temperature range of 600° C. or lower and 450° C. or higher and stopped at a temperature of (the Ms transformation point −20° C.) or higher in terms of surface temperature.

Subsequently, a preferable method for manufacturing the high strength hot rolled steel sheet with low yield ratio according to embodiments of the present disclosure will be described.

In embodiments, a steel material having the chemical composition described above is made into a hot rolled steel sheet by performing a processing operation using a hot rolling process, a cooling process, and a coiling process on the steel material.

Here, it is not necessary to put a particular limitation on what method is used for manufacturing a steel material to be used, and it is preferable that a steel material such as a slab is manufactured by smelting molten steel having the chemical composition described above using a commonly well-known smelting method such as one using a converter or an electric furnace and by casting the smelted molten steel using a commonly well-known smelting method such as a continuous casting method.

The obtained steel material is subjected to a processing operation using a hot rolling process.

In the hot rolling process, the steel material having the chemical composition described above is made into a hot rolled steel sheet by heating the steel material at a heating temperature of 1050° C. or higher and 1300° C. or lower, by performing roughing rolling on the heated steel material in order to make a transfer bar, and by performing finishing rolling on the transfer bar so that the cumulative reduction in a temperature range of 930° C. or lower is 50% or more.

Heating Temperature: 1050° C. or Higher and 1300° C. or Lower

It is necessary that the steel material which is used in certain embodiments contain Nb and Ti as described above. It is necessary that the carbides, nitrides and the like of these chemical elements having a large grain diameter be firstly dissolved and finely precipitated thereafter in order to achieve the desired high strength through precipitation strengthening. Therefore, the heating temperature of the steel material is set to be 1050° C. or higher. In the case where the heating temperature is lower than 1050° C., since these chemical elements remain undissolved, the desired strength of the steel sheet cannot be achieved. On the other hand, in the case where the heating temperature is higher than 1300° C., since there is an excessive increase in crystal grain diameter, there is a decrease in the toughness of a steel sheet. Therefore, the heating temperature of the steel material is limited to 1050° C. or higher and 1300° C. or lower.

The steel material heated at the heating temperature described above is subjected to roughing rolling and made into a transfer bar. It is not necessary to put a particular limitation on what condition is used for roughing rolling as long as a transfer bar having desired dimensions and a shape are obtained.

The obtained transfer bar is subsequently subjected to finishing rolling and made into a hot rolled steel sheet having desired dimensions and a shape. Hot rolling performed in finish rolling is performed so that the cumulative rolling reduction in a temperature range of 930° C. or lower is 50% or more.

Cumulative Rolling Reduction in a Temperature Range of 930° C. or Lower: 50% or More In order to realize a decrease in the grain diameter of a bainitic ferrite phase and the fine dispersion of a massive martensitic phase in the microstructure of the inner layer, the cumulative rolling reduction in a temperature range of 930° C. or lower is set to be 50% or more. In the case where the cumulative rolling reduction in a temperature range of 930° C. or lower is less than 50%, since there is insufficient rolling reduction, it is impossible to decrease the grain diameter of a bainitic ferrite phase which is the main phase in the microstructure of the inner layer. In addition, since there is an insufficient amount of a bainitic ferrite phase formed in the grains due to an insufficient amount of dislocations which become the precipitation sites of, for example, NbC which promotes γ to a transformation nucleation, it is impossible to retain a massive untransformed γ for forming a massive martensitic phase in the finely dispersed state in large amounts. Therefore, the cumulative rolling reduction in finishing rolling in a temperature range of 930° C. or lower is limited to 50% or more, preferably 80% or less. In the case where the cumulative rolling reduction is more than 80%, the effect becomes saturated, and in addition, since a significant amount of separation occurs, there may be a decrease in absorbed energy in a Charpy impact test.

Here, it is preferable that the finishing delivery temperature be 850° C. or lower and 760° C. or higher from the viewpoint of, for example, the toughness and strength of a steel sheet and rolling load. In the case where the finishing delivery temperature is higher than 850° C., since it is necessary that rolling reduction per pass be increased in order to ensure that the cumulative rolling reduction in a temperature range of 930° C. or lower is 50% or more, there may be an increase in rolling load. On the other hand, in the case where the finishing delivery temperature is lower than 760° C., since there is an excessive increase in the grain diameter of a microstructure and precipitates due to the formation of a ferrite phase when rolling is performed, there may be a decrease in low-temperature toughness and strength.

The obtained hot rolled steel sheet is subsequently subjected to a processing operation using a cooling process.

In a cooling process, cooling is started immediately, preferably within 15 seconds, after finishing rolling has been performed, and a first cooling and a second cooling are performed in this order.

In the first cooling, in terms of the temperature of the central part of the thickness, cooling is performed at an average cooling rate of 5° C./s or more and 30° C./s or less in a temperature range of 750° C. to 600° C. and stopped at a cooling stop temperature in a range of 600° C. or lower and 450° C. or higher.

The first cooling is performed, in terms of the temperature of the central part of the thickness, at an average cooling rate of 5° C./s or more and 30° C./s or less in a temperature range of 750° C. to 600° C. In the case where the average cooling rate is less than 5° C./s, since a microstructure mainly including a polygonal ferrite phase is formed, it is difficult to obtain the desired microstructure mainly including a bainitic ferrite phase, and there is an increase in lath thickness. On the other hand, in the case where the average cooling rate is high as more than 30° C./s, since there is an insufficient amount of alloy chemical elements concentrated in an untransformed austenite phase, it is impossible to finely disperse a desired amount of a massive martensitic phase when cooling is performed thereafter, which results in the desired low yield ratio and desired excellent low-temperature toughness being difficult to achieve. Therefore, the first cooling is characterized in that, in terms of the temperature of the central part of the thickness, an average cooling rate is limited to 5° C./s or more and 30° C./s or less, preferably 5° C./s or more and 25° C./s or less, in a temperature range of 750° C. to 600° C. which is a temperature range in which a polygonal ferrite phase is formed. Here the temperature of the central part of the thickness can be derived on the basis of, for example, the surface temperature of a steel sheet, the temperature of cooling water, and the amount of water using, for example, heat-transfer calculation.

The cooling stop temperature of the first cooling is set to be in a temperature range of 600° C. or lower and 450° C. or higher in terms of the temperature of the central part of the thickness. In the case where the cooling stop temperature is higher than 600° C., it is difficult to achieve the desired microstructure mainly including a bainitic ferrite phase. On the other hand, in the case where the cooling stop temperature is lower than 450° C., since an untransformed γ substantially complete transformation, it is impossible to achieve a desired amount of a massive martensitic phase. Therefore, the cooling stop temperature of the first cooling is set to be in a temperature range of 600° C. or lower and 450° C. or higher in terms of the temperature of the central part of the thickness.

Here, the first cooling, which is characterized by the control in the central part of the thickness as described above, is further characterized in that, in terms of surface temperature, cooling is performed at an average cooling rate of 100° C./s or less in a temperature range of 600° C. or lower and 450° C. or higher (equal to or lower than the bainite transformation point) and stopped at a cooling stop temperature equal to or higher than (the Ms transformation point −20° C.) in terms of surface temperature.

In the case where, in terms of surface temperature, rapid cooling is performed at a high average cooling rate of more than 100° C./s in a temperature range of 600° C. or lower and 450° C. or higher (equal to or lower than the bainite transformation point), since there is an increase in the hardness of the surface layer compared with the inner layer, and since the distribution of surface hardness often becomes non-uniform, there are variations in the properties of a steel pipe. Therefore, in the first cooling, in terms of surface temperature, the average cooling rate is controlled to be 100° C./s or less. With this method, since a non-uniform increase in surface hardness can be prevented, uniform deformation is realized when pipe-making is performed, which results in a steel pipe excellent in terms of pipe shape being achieved after pipe-making has been performed. It is preferable that the average cooling rate be 90° C./s or less.

Here, since an average cooling rate in a temperature range of 600° C. or lower and 450° C. or higher is specified in terms of surface temperature in the first cooling, it is appropriate that a cooling rate be controlled to be 100° C. or less while cooling is performed continuously or an average cooling rate be adjusted to be 100° C. or less while cooling is performed intermittently at short intervals. That is because, since a cooling device is generally equipped with plural cooling nozzles and the nozzles are divided into cooling banks which are formed by bundling plural cooling nozzles, cooling can be performed both continuously and intermittently with air cooling interposed by coordinating cooling banks to be used.

In addition, in the case where a cooling stop temperature of the first cooling is lower than (the Ms point −20° C.) in terms of surface temperature, since the surface layer is composed of a single martensitic phase microstructure, a single tempered martensitic phase microstructure is formed as a result of being tempered thereafter, which results in an increase in yield ratio. Therefore, the cooling stop temperature of the first cooling is limited by controlling a cooling process to being equal to or higher than (the Ms point −20° C.) in terms of surface temperature. It is preferable that the cooling stop temperature be equal to or higher than the Ms point in terms of surface temperature. Here, for example, by immediately forming a temperature gradient in the thickness direction inside a steel sheet, and by controlling the cooling rate of the surface layer thereafter, it is possible to separately control the cooling rates of the surface layer and the central part of the thickness of the steel sheet within desired ranges respectively.

After the first cooling has been performed, the second cooling is further performed in a manner such that cooling is performed at an average cooling rate of 2° C./s or less in terms of temperature in the central part of the thickness in a temperature range from the cooling stop temperature of the first cooling to a coiling temperature or that the hot rolled steel sheet is held in the temperature range described above from the cooling stop temperature of the first cooling to a coiling temperature for a holding time of 20 seconds or more.

In the second cooling, slow cooling such as schematically illustrated in terms of the temperature of the central part of the thickness in FIG. 1 is performed in a temperature range from the cooling stop temperature of the first cooling to a coiling temperature. Since alloy chemical elements such as C are further diffused into an untransformed γ by performing slow cooling in this temperature range, the untransformed γ is stabilized, which results in the formation of a massive martensitic phase with ease due to cooling thereafter. In order to realize such slow cooling, cooling is performed in a manner such that cooling is performed at an average cooling rate of 2° C./s or less in terms of temperature in the central part of the thickness, preferably 1.5° C./s or less, in the temperature range described above from the cooling stop temperature of the first cooling to a coiling temperature or that the hot rolled steel sheet is held in the temperature range described above from the cooling stop temperature of the first cooling to a coiling temperature for a holding time of 20 seconds or more.

In the case where the cooling rate in the temperature range from the cooling stop temperature of the first cooling to a coiling temperature is more than 2° C./s, since alloy chemical elements such as C cannot be sufficiently diffused into an untransformed γ, the untransformed γ is not sufficiently stabilized. Therefore, the untransformed γ is left in a rod-like shape between bainitic ferrite grains as in the case of cooling illustrated using a dotted line in FIG. 1, which results in a desired massive martensitic phase being difficult to form.

Here, it is preferable that this second cooling be performed by stopping water injection in the latter part of a run out table. In the case of a steel sheet having a small thickness, it is preferable, for example, that cooling water remaining on the surface of the steel sheet be completely removed and that a heat-retaining cover be equipped in order to realize the desired cooling conditions. Moreover, it is preferable that transferring speed be controlled in order to ensure that the steel sheet is held in the temperature range described above for a holding time of 20 seconds or more.

After the second cooling has been performed, the hot rolled steel sheet is subjected to a processing operation using a coiling process.

In the coiling process, coiling is performed at a coiling temperature of 450° C. or higher in terms of surface temperature.

In the case where the coiling temperature is lower than 450° C., it is impossible to achieve the desired low yield ratio. Therefore, the coiling temperature is limited to 450° C. or higher. By performing coiling as described above, it is possible to hold the hot rolled steel sheet in a temperature range in which a ferrite phase and an austenite phase are both present for a specified time or more.

Using the hot rolled steel sheet which has been manufactured using the manufacturing method described above as a raw material for pipe-making, a spiral steel pipe or an ERW pipe is manufactured using a common pipe-making process. It is not necessary to put a particular limitation on what pipe-making process is used, and any common process may be used.

EXAMPLES

Molten steels having the chemical compositions given in Table 1 were smelted using a converter and made into steel materials (slabs having a thickness of 220 mm) using a continuous casting method. Subsequently, these steel materials were heated at the temperatures given in Table 2 and Table 5 and made into transfer bars by performing roughing rolling, and then the transfer bars were subjected a processing operation using a hot rolling process in which hot rolled steel sheets (having a thickness of 8 to 25 mm) were manufactured by performing finishing rolling under the conditions given in Table 2 and Table 5.

The obtained hot rolled steel sheets were subjected to a processing operation using a cooling process which was started immediately, within the times given in Table 2 and Table 5, after finishing rolling had been performed. The cooling process consisted of a first cooling and a second cooling. In the first cooling, cooling was performed at the average cooling rates in terms of the temperature of the central part of the thickness given in Table 2 and Table 5 to the cooling stop temperatures in terms of the temperature of the central part of the thickness given in Table 2 and Table 5. Here, in the first cooling, cooling was performed by coordinating plural cooling banks at the average cooling rates in a temperature range of 750° C. to 600° C. in terms of surface temperature given in Table 2 and Table 5 to the cooling stop temperature in terms of surface temperature of the surface layer given in Table 2 and Table 5.

After the first cooling had been performed, the second cooling was performed under the conditions given in Table 2 and Table 5. In the second cooling, cooling was performed under the conditions given in Table 2 and Table 5 from the cooling stop temperatures of the first cooling given in Table 2 and Table 5 to the coiling temperatures given in Table 2 and Table 5.

After the second cooling had been performed, the hot rolled steel sheets were subjected a processing operation using a coiling process, in which the hot rolled steel sheets were coiled at the coiling temperatures given in Table 2 and Table 5 and then allowed to cool.

Using test pieces collected from the obtained hot rolled steel sheets, microstructure observation, a tensile test, and an impact test were conducted. The methods of the tests were as follows.

(1) Microstructure Observation

A test piece for microstructure observation was collected from the obtained hot rolled steel sheet so that a cross section in the rolling direction (L cross section) was the observation surface. Using the test piece which had been polished and etched using a nital solution, microstructure observation was conducted using an optical microscope (at a magnification of 500 times) or a scanning electron microscope (at a magnification of 2000 times) and a photograph was taken. Using the obtained microstructure photograph, the kinds of microstructures and the fractions (area fractions) and average grain diameters of various phases were determined. Here, the positions where microstructure observation was performed were a surface layer (a position located at 1.5 mm from the surface of the steel sheet) and the central part of the thickness.

The average grain diameter of a bainitic ferrite phase and the average grain diameter and maximum grain diameter of a tempered martensitic phase were determined using an intercept method in accordance with JIS G 0552. In addition, the aspect ratio of a martensitic grain was defined as the ratio between the length (long side) in the longitudinal direction of each grain, that is, the direction in which the grain diameter was the maximum and the length (short side) in the direction at a right angle to the direction of the long side, that is, (long side)/(short side) of each grain. A martensite grain having an aspect ratio of less than 5.0 is defined as a massive martensitic phase, and a martensite grain having an aspect ratio of 5.0 or more is referred to as a "rod-like" martensitic phase. In addition, the size of a massive martensitic phase was expressed in terms of diameter which is defined as the sum of a long-side length and a short-side length of each martensite grain divided by 2, and the arithmetic average of the calculated diameters of all the grains was defined as the average size of a massive martensitic phase of the steel sheet. The maximum value among the diameters of all the grains of a massive martensitic phase was defined as the maximum size of a massive martensitic phase. The number of grains of a martensitic phase whose sizes were determined was 100 or more.

In addition, using a thin film test piece which was prepared by collecting a test piece for a thin film from the obtained hot rolled steel sheet and by performing grinding, mechanical polishing, electrolytic polishing, and so forth, microstructure observation was conducted using a transmission electron microscope (at a magnification of 20000 times) in order to determine the lath thickness of a bainitic ferrite phase. The number of fields observed was 3 or more. Here, in order to determine a lath thickness, a line segment was drawn in a direction at a right angle to the laths, the lengths of the line segments between the laths were determined, and the average value of the determined lengths was defined as a lath thickness. Here, the positions where the test pieces for a thin film were collected were a surface layer (a position located at 1.5 mm from the surface of the steel sheet) and the central part of the thickness.

(2) Tensile Test

Using tensile test pieces (full-thickness test pieces prescribed in the API-5L having a GL of 50 mm and a width of 38.1 mm) which were collected from the obtained hot rolled steel sheet so that the tensile directions are respectively the rolling direction, a direction at a right angle to the rolling direction (width direction of the steel sheet), and a direction at an angle of 30 degrees to the rolling direction, a tensile test was conducted in accordance with the prescription in ASTM A 370 in order to determine tensile properties (yield strength YS and tensile strength TS).

(3) Impact Test

Using a V-notch test piece which was collected from the obtained hot rolled steel sheet so that the longitudinal direction of the test piece was at a right angle to the rolling direction, a Charpy impact test was conducted in accordance with the prescription in ASTM A 370 in order to determine a fracture transition temperature vTrs (° C.).

The obtained results are given in Table 3, Table 4, table 6, and Table 7.

Subsequently, using the obtained hot rolled steel sheet as a raw material of a pipe, a spiral steel pipe (having an outer diameter of 1067 mmΦ) was manufactured using a spiral pipe-making process. Using a tensile test piece (test piece prescribed in the API standards) which was collected from the obtained steel pipe so that the tensile direction is spherical direction of the pipe, a tensile test was conducted in accordance with the prescription in ASTM A 370, and tensile properties (yield strength YS and tensile strength TS) were determined. ΔYS (=the YS of the steel pipe−the YS of the steel sheet in a direction at 30°) was calculated from the obtained results in order to evaluate the degree of a decrease in strength due to pipe-making. It is preferable that ΔYS be −10 MPa or more and 90 MPa or less from the viewpoint of the stability of pipe strength. It is not preferable that ΔYS be less than −10 MPa (the YS of a steel pipe is more than 10 MPa less than the YS of the steel sheet in a direction at 30°), because a decrease in YS after pipe-making has been performed is excessively large. It is not preferable that ΔYS be more than 90 MPa, because a change in strength due to strain caused by pipe-making tends to occur.

The obtained results are also given in Table 4 and Table 7 additionally.

TABLE 1

| Steel | Chemical composition (mass %) | | | | | | | | | | | | | | | |
|---|---|---|---|---|---|---|---|---|---|---|---|---|---|---|---|---|
| No. | C | Si | Mn | P | S | Al | N | Nb | Ti | Mo | Cr | Ni | Cu, V, B | Ca | Moeq* | Note |
| A | 0.064 | 0.22 | 1.64 | 0.008 | 0.0011 | 0.036 | 0.0039 | 0.065 | 0.014 | 0.29 | 0.08 | 0.02 | — | — | 1.58 | Example |
| B | 0.052 | 0.29 | 1.74 | 0.009 | 0.0006 | 0.035 | 0.0034 | 0.052 | 0.013 | 0.38 | 0.11 | 0.12 | V: 0.022 | — | 1.77 | Example |
| C | 0.070 | 0.46 | 1.88 | 0.007 | 0.0012 | 0.033 | 0.0032 | 0.071 | 0.017 | 0.24 | 0.23 | 0.21 | V: 0.039, B: 0.0001 | 0.0021 | 1.79 | Example |
| D | 0.041 | 0.42 | 1.46 | 0.009 | 0.0014 | 0.039 | 0.0032 | 0.033 | 0.021 | 0.29 | 0.48 | 0.06 | V: 0.090 | 0.0023 | 1.59 | Example |
| E | 0.083 | 0.38 | 1.91 | 0.010 | 0.0023 | 0.042 | 0.0042 | 0.097 | 0.009 | 0.26 | 0.41 | 0.20 | B: 0.0004 | — | 1.89 | Example |
| F | 0.035 | 0.02 | 2.16 | 0.010 | 0.0015 | 0.035 | 0.0029 | 0.042 | 0.041 | 0.29 | 0.37 | 0.40 | Cu: 0.25 | 0.0024 | 2.11 | Example |
| G | 0.162 | 0.22 | 1.42 | 0.014 | 0.0019 | 0.035 | 0.0027 | 0.060 | 0.013 | 0.01 | 0.38 | 0.28 | Cu: 0.29 | 0.0022 | 1.26 | Comparative Example |

TABLE 1-continued

| Steel No. | Chemical composition (mass %) C | Si | Mn | P | S | Al | N | Nb | Ti | Mo | Cr | Ni | Cu, V, B | Ca | Moeq* | Note |
|---|---|---|---|---|---|---|---|---|---|---|---|---|---|---|---|---|
| H | 0.046 | 0.36 | 1.15 | 0.008 | 0.0025 | 0.051 | 0.0035 | 0.046 | 0.009 | 0.32 | 0.26 | 0.42 | V: 0.022, B: 0.0002 | 0.0024 | 1.33 | Comparative Example |
| I | 0.051 | 0.17 | 1.57 | 0.007 | 0.0032 | 0.036 | 0.0038 | 0.051 | 0.012 | 0.09 | — | — | V: 0.055, B: 0.0001 | — | 1.30 | Comparative Example |
| J | 0.040 | 0.17 | 1.65 | 0.009 | 0.0029 | 0.040 | 0.0046 | 0.042 | 0.015 | — | — | 0.18 | V: 0.025, Cu: 0.15 | — | 1.27 | Comparative Example |
| K | 0.079 | 0.42 | 1.60 | 0.011 | 0.0012 | 0.046 | 0.0033 | 0.129 | 0.021 | 0.31 | 0.19 | 0.11 | B: 0.0003 | 0.0026 | 1.62 | Comparative Example |
| L | 0.063 | 0.22 | 1.64 | 0.009 | 0.0009 | 0.035 | 0.0028 | 0.054 | 0.069 | 0.18 | 0.28 | 0.10 | — | — | 1.55 | Comparative Example |
| M | 0.091 | 0.14 | 1.62 | 0.012 | 0.0007 | 0.037 | 0.0034 | 0.056 | 0.017 | 0.11 | 0.05 | 0.01 | V: 0.055 | 0.0019 | 1.38 | Example |

*Moeq (%) = Mo + 0.36Cr + 0.77Mn + 0.07Ni

TABLE 2

| | | Hot Rolling Process | | | | | Cooling Process | | |
|---|---|---|---|---|---|---|---|---|---|
| | | Heating | Roughing Rolling | Finishing Rolling | | | | First Cooling Inner layer | |
| Steel Sheet No. | Steel No. | Heating Temperature (° C.) | Transfer bar Thickness (mm) | Finishing Delivery Temperature (° C.) | Rolling Reduction*1 (%) | Thickness (mm) | Cooling Start Time (s) | Average Cooling Rate*2 (° C./s) | Cooling Stop Temperature*3 (° C.) |
| 1 | A | 1169 | 59 | 775 | 77 | 8 | 2.4 | 20 | 518 |
| 2 | A | 1150 | 58 | 772 | 57 | 25 | 7.6 | 28 | 514 |
| 3 | A | 1072 | 50 | 770 | 60 | 16 | 4.8 | 16 | 518 |
| 4 | A | 1157 | 56 | 759 | 69 | 14 | 4.2 | 18 | 513 |
| 5 | A | 1218 | 59 | 776 | 64 | 19 | 5.8 | 14 | 511 |
| 6 | A | 1180 | 55 | 764 | 67 | 16 | 4.8 | 18 | 507 |
| 7 | A | 1300 | 50 | 762 | 68 | 16 | 4.8 | 14 | 512 |
| 8 | A | 1279 | 53 | 761 | 71 | 14 | 4.2 | 16 | 509 |
| 9 | A | 1197 | 52 | 760 | 50 | 16 | 4.8 | 20 | 513 |
| 10 | A | 1181 | 55 | 776 | 68 | 14 | 4.2 | 55 | 518 |
| 11 | A | 1277 | 52 | 777 | 66 | 16 | 4.8 | 14 | 614 |
| 12 | A | 1265 | 56 | 777 | 62 | 21 | 6.4 | 20 | 435 |
| 13 | A | 1273 | 53 | 764 | 53 | 25 | 7.6 | 18 | 522 |
| 14 | A | 1211 | 56 | 758 | 66 | 19 | 5.8 | 16 | 465 |
| 15 | B | 1217 | 59 | 788 | 81 | 11 | 3.3 | 22 | 506 |
| 16 | C | 1223 | 53 | 769 | 79 | 10 | 3.0 | 23 | 519 |
| 17 | D | 1181 | 52 | 819 | 61 | 18 | 5.5 | 13 | 521 |
| 18 | E | 1176 | 58 | 753 | 66 | 16 | 4.8 | 14 | 496 |
| 19 | F | 1155 | 51 | 759 | 50 | 21 | 6.4 | 12 | 458 |
| 20 | G | 1188 | 51 | 737 | 69 | 16 | 4.8 | 14 | 535 |
| 21 | H | 1157 | 58 | 803 | 76 | 11 | 3.3 | 20 | 544 |
| 22 | I | 1217 | 59 | 774 | 51 | 25 | 7.6 | 10 | 587 |
| 23 | J | 1163 | 59 | 782 | 71 | 13 | 3.9 | 18 | 605 |
| 24 | K | 1259 | 56 | 787 | 76 | 11 | 3.3 | 12 | 530 |
| 25 | L | 1153 | 52 | 785 | 70 | 14 | 4.2 | 16 | 547 |
| 26 | M | 1244 | 55 | 759 | 70 | 14 | 4.2 | 25 | 558 |
| 27 | A | 1160 | 50 | 784 | 60 | 12 | 3.0 | 22 | 550 |

| | Cooling Process | | | | | | |
|---|---|---|---|---|---|---|---|
| | First Cooling Surface Layer | | | Second Cooling | | Coiling Process | |
| Steel Sheet No. | Ms (° C.) | Average Cooling Rate*4 (° C./s) | Cooling Stop Temperature*5 (° C.) | Average Cooling Rate*6 (° C./s) | Holding Time*7 (s) | Coiling Temperature*8 (° C.) | Note |
| 1 | 408 | 32 | 426 | 1.5 | 24 | 526 | Example |
| 2 | 408 | 98 | 421 | 0.5 | 33 | 536 | Example |
| 3 | 408 | 51 | 422 | 1.0 | 28 | 537 | Example |
| 4 | 408 | 50 | 426 | 1.0 | 27 | 540 | Example |
| 5 | 408 | 53 | 420 | 0.5 | 30 | 521 | Example |
| 6 | 408 | 58 | 420 | — | 28 | 531 | Example |
| 7 | 408 | 45 | 420 | 1.0 | 28 | 538 | Example |
| 8 | 408 | 45 | 425 | 3.0 | — | 536 | Comparative Example |
| 9 | 408 | 64 | 420 | — | 28 | 531 | Example |
| 10 | 408 | 154 | 424 | 1.0 | 27 | 537 | Comparative Example |
| 11 | 408 | 45 | 419 | 1.0 | 28 | 540 | Comparative Example |
| 12 | 408 | 84 | 392 | 0.5 | 31 | 521 | Comparative Example |

TABLE 2-continued

| | | | | | | | |
|---|---|---|---|---|---|---|---|
| 13 | 408 | 105 | 421 | 1.0 | 33 | 526 | Comparative Example |
| 14 | 408 | 61 | 390 | 0.5 | 30 | 525 | Example |
| 15 | 406 | 48 | 424 | 1.0 | 26 | 504 | Example |
| 16 | 392 | 46 | 408 | 1.0 | 25 | 504 | Example |
| 17 | 417 | 47 | 435 | 1.0 | 29 | 517 | Example |
| 18 | 382 | 45 | 396 | 1.0 | 28 | 484 | Example |
| 19 | 393 | 50 | 404 | 0.5 | 31 | 451 | Example |
| 20 | 365 | 45 | 385 | 1.0 | 28 | 530 | Comparative Example |
| 21 | 422 | 44 | 438 | 0.5 | 26 | 535 | Comparative Example |
| 22 | 422 | 50 | 437 | 0.5 | 33 | 575 | Comparative Example |
| 23 | 424 | 47 | 438 | 0.5 | 27 | 590 | Comparative Example |
| 24 | 398 | 26 | 412 | 0.5 | 26 | 522 | Comparative Example |
| 25 | 406 | 45 | 424 | 1.0 | 27 | 528 | Comparative Example |
| 26 | 407 | 70 | 414 | 0.5 | 27 | 548 | Example |
| 27 | 408 | 35 | 480 | — | 30 | 498 | Example |

*1 Cumulative rolling reduction (%) in a temperature range of 930° C. or lower

*2 Average cooling rate in a temperature range of 750° C. or lower and 600° C. or higher (temperature of the central part of the thickness)

*3 Temperature of the central part of the thickness derived by heat-transfer calculation

*4 Average cooling rate in a temperature range of 600° C. or lower and 450° C. or higher (surface temperature)

*5 Surface temperature at the time of cooling stop

*6 Average cooling rate from the cooling stop temperature of the first cooling to the coiling temperature (temperature of the central part of the thickness)

*7 Holding time in a temperature range from the cooling stop temperature of the first cooling to the coiling temperature (temperature of the central part of the thickness)

*8 Surface Temperature

TABLE 3

| | | Surface Layer Microstructure | | | | | | | | Inner Layer Microstructure | | |
|---|---|---|---|---|---|---|---|---|---|---|---|---|
| | | | BF | | | Second Phase Martensite | | | | BF | | |
| Steel Sheet No. | Steel No. | Phase*1 | Fraction (area %) | Average Grain Diameter (μm) | Lath Thickness (μm) | Fraction (area %) | Average Grain Diameter (μm) | Maximum Grain Diameter (μm) | Phase*1 | Fraction (area %) | Average Grain Diameter (μm) | Lath Thickness (μm) |
| 1 | A | BF | 100 | 3.4 | 0.28 | 0.0 | — | — | BF + M | 96.0 | 3.9 | 0.60 |
| 2 | A | BF + TM | 98.0 | 4.0 | 0.20 | 2.0 | 1.1 | 2.2 | BF + M + B | 94.7 | 4.7 | 0.31 |
| 3 | A | BF + TM | 99.5 | 4.5 | 0.32 | 0.5 | 1.2 | 2.3 | BF + M | 95.6 | 4.8 | 0.77 |
| 4 | A | BF + TM | 99.5 | 4.6 | 0.29 | 0.5 | 1.0 | 2.0 | BF + M | 96.0 | 4.9 | 0.68 |
| 5 | A | BF + TM | 99.5 | 4.5 | 0.32 | 0.5 | 1.2 | 2.4 | BF + M | 95.7 | 5.0 | 0.86 |
| 6 | A | BF + TM | 99.4 | 4.0 | 0.29 | 0.6 | 1.3 | 2.4 | BF + M | 95.4 | 4.7 | 0.68 |
| 7 | A | BF + TM | 99.7 | 10.2 | 0.42 | 0.3 | 3.1 | 6.1 | BF + M | 94.6 | 11.8 | 0.86 |
| 8 | A | BF + TM | 99.7 | 4.3 | 0.45 | 0.3 | 1.3 | 2.5 | BF + M | 94.9 | 4.8 | 0.77 |
| 9 | A | BF + TM | 99.2 | 9.6 | 0.31 | 0.8 | 2.2 | 4.4 | BF + M | 94.8 | 10.7 | 0.60 |
| 10 | A | BF + TM | 94.4 | 4.1 | 0.14 | 5.6 | 1.2 | 2.3 | BF + M + B | 93.5 | 4.7 | 0.11 |
| 11 | A | BF + TM | 99.7 | 4.4 | 0.43 | 0.3 | 1.2 | 2.4 | BF + B | 95.0 | 4.9 | 0.86 |
| 12 | A | BF + TM | 98.5 | 4.7 | 0.26 | 1.5 | 0.9 | 1.8 | BF | 100.0 | 5.1 | 0.60 |
| 13 | A | BF + TM | 97.5 | 4.6 | 0.13 | 2.5 | 1.0 | 2.0 | BF + M | 95.1 | 5.1 | 0.68 |
| 14 | A | BF + TM | 99.3 | 4.4 | 0.20 | 0.7 | 1.3 | 2.6 | BF + M | 94.7 | 4.9 | 0.77 |
| 15 | B | BF + TM | 99.6 | 3.8 | 0.24 | 0.4 | 0.9 | 1.7 | BF + M | 95.2 | 4.0 | 0.52 |
| 16 | C | BF + TM | 99.6 | 4.1 | 0.20 | 0.4 | 1.0 | 2.0 | BF + M | 95.7 | 4.3 | 0.48 |
| 17 | D | BF + TM | 99.6 | 4.6 | 0.34 | 0.4 | 0.9 | 1.8 | BF + M + B | 91.3 | 5.1 | 0.90 |
| 18 | E | BF + TM | 99.7 | 3.9 | 0.33 | 0.3 | 0.9 | 1.8 | BF + M + B | 88.7 | 4.5 | 0.86 |
| 19 | F | BF + TM | 99.5 | 4.5 | 0.34 | 0.5 | 0.9 | 1.9 | BF + M | 93.0 | 4.9 | 0.95 |
| 20 | G | BF + TM | 99.7 | 4.2 | 0.38 | 0.3 | 1.3 | 2.4 | BF + M + B | 75.4 | 4.7 | 0.86 |
| 21 | H | BF + TM | 99.7 | 12.2 | 0.29 | 0.3 | 2.6 | 5.0 | BF + M + P | 86.6 | 13.4 | 0.60 |
| 22 | I | BF + TM | 99.6 | 4.5 | 0.44 | 0.4 | 1.1 | 2.2 | BF + M | 98.9 | 5.0 | 1.05 |
| 23 | J | BF + TM | 99.6 | 3.7 | 0.36 | 0.4 | 1.0 | 1.9 | BF + M | 99.2 | 4.3 | 0.68 |
| 24 | K | BF | 100 | 4.0 | 0.41 | 0.0 | 1.0 | 2.0 | BF + M | 93.9 | 4.5 | 0.95 |
| 25 | L | BF + TM | 99.7 | 9.5 | 0.33 | 0.3 | 2.8 | 5.5 | BF + M + F | 94.6 | 11.1 | 0.77 |
| 26 | M | BF + TM | 99.0 | 4.2 | 0.30 | 1.0 | 1.0 | 1.9 | BF + M + B | 95.1 | 4.7 | 0.41 |
| 27 | A | BF + TM | 97.1 | 7.5 | 0.25 | 2.9 | 2.3 | 4.5 | BF + M | 92.6 | 4.7 | 0.39 |

| | Inner Layer Microstructure Second Phase | | | | | | |
|---|---|---|---|---|---|---|---|
| | Massive M | | | | | | |
| Steel Sheet No. | Fraction (area %) | Average Size (μm) | Maximum Size (μm) | Aspect Ratio | Rod-like M Fraction*2 (area %) | Other Phase*1: area % | Note |
| 1 | 3.5 | 1.2 | 3.9 | 4.0 | 0.5 | — | Example |
| 2 | 4.3 | 1.5 | 4.4 | 3.5 | 0.5 | B: 0.5 | Example |

TABLE 3-continued

| | | | | | | | |
|---|---|---|---|---|---|---|---|
| 3 | 3.9 | 1.4 | 4.4 | 3.5 | 0.5 | — | Example |
| 4 | 3.5 | 1.3 | 4.4 | 2.5 | 0.5 | — | Example |
| 5 | 3.8 | 1.4 | 4.5 | 3.0 | 0.5 | — | Example |
| 6 | 4.1 | 1.4 | 4.5 | 3.0 | 0.5 | — | Example |
| 7 | 4.9 | 1.7 | 6.2 | 3.0 | 0.5 | — | Example |
| 8 | 0.6 | 0.2 | 2.6 | 3.0 | 4.5 | — | Comparative Example |
| 9 | 4.2 | 1.4 | 5.5 | 3.0 | 1.0 | — | Example |
| 10 | 3.8 | 1.3 | 4.0 | 2.5 | 0.2 | B: 2.5 | Comparative Example |
| 11 | 0.0 | — | — | — | — | B: 5.0 | Comparative Example |
| 12 | 0.0 | — | — | — | — | — | Comparative Example |
| 13 | 3.9 | 1.4 | 4.5 | 3.5 | 1.0 | — | Comparative Example |
| 14 | 4.4 | 1.6 | 4.5 | 3.0 | 0.9 | — | Example |
| 15 | 3.7 | 1.3 | 4.4 | 3.5 | 1.1 | — | Example |
| 16 | 3.8 | 1.3 | 4.2 | 4.5 | 0.5 | — | Example |
| 17 | 4.1 | 1.4 | 4.6 | 2.5 | 1.6 | B: 3.0 | Example |
| 18 | 3.8 | 1.4 | 4.4 | 2.0 | 0.5 | B: 7.0 | Example |
| 19 | 5.4 | 1.8 | 5.1 | 3.0 | 1.6 | — | Example |
| 20 | 4.5 | 1.6 | 2.9 | 3.5 | 0.1 | B: 20 | Comparative Example |
| 21 | 3.3 | 1.1 | 3.2 | 3.5 | 0.1 | P: 10 | Comparative Example |
| 22 | 1.0 | 0.4 | 15.0 | 3.0 | 0.1 | — | Comparative Example |
| 23 | 0.7 | 0.4 | 1.1 | 2.0 | 0.1 | — | Comparative Example |
| 24 | 5.0 | 1.7 | 4.9 | 4.0 | 1.1 | — | Comparative Example |
| 25 | 3.9 | 1.3 | 5.3 | 3.5 | 0.5 | F: 1.0 | Comparative Example |
| 26 | 3.3 | 1.1 | 3.8 | 3.0 | 0.6 | B: 1.0 | Example |
| 27 | 6.5 | 2.5 | 4.9 | 4.9 | 0.9 | — | Example |

*1 F: ferrite P: pearlite, B: bainite, BF: bainitic ferrite, M: martensite, TM: tempered martensite

*2 (amount of martensite having an aspect ratio of 5.0 or more)/(total amount of martensite)

TABLE 4

| Steel | | Tensile Property | | | | Toughness | Pipe Strength | | | Change in Strength | |
|---|---|---|---|---|---|---|---|---|---|---|---|
| Sheet No. | Steel No. | YS (MPa) | TS (MPa) | YR (%) | YS30°*1 (MPa) | vTrs (° C.) | YS (MPa) | TS (MPa) | YR (%) | ΔYS*2 (MPa) | Note |
| 1 | A | 576 | 694 | 83 | 554 | −115 | 565 | 665 | 85 | 11 | Example |
| 2 | A | 587 | 699 | 84 | 564 | −85 | 596 | 674 | 87 | 22 | Example |
| 3 | A | 587 | 699 | 84 | 570 | −110 | 582 | 677 | 86 | 12 | Example |
| 4 | A | 573 | 699 | 82 | 556 | −90 | 586 | 673 | 87 | 30 | Example |
| 5 | A | 553 | 700 | 79 | 544 | −100 | 553 | 675 | 82 | 9 | Example |
| 6 | A | 560 | 700 | 80 | 544 | −100 | 563 | 678 | 83 | 18 | Example |
| 7 | A | 581 | 717 | 81 | 560 | −80 | 583 | 694 | 84 | 23 | Example |
| 8 | A | 635 | 721 | 88 | 599 | −110 | 579 | 698 | 83 | −20 | Comparative Example |
| 9 | A | 586 | 715 | 82 | 578 | −80 | 580 | 691 | 84 | 2 | Example |
| 10 | A | 802 | 692 | 87 | 595 | −120 | 567 | 667 | 85 | −29 | Comparative Example |
| 11 | A | 590 | 671 | 88 | 565 | −60 | 537 | 647 | 83 | −28 | Comparative Example |
| 12 | A | 622 | 699 | 89 | 602 | −110 | 543 | 670 | 81 | −59 | Comparative Example |
| 13 | A | 613 | 705 | 87 | 602 | −110 | 562 | 677 | 83 | −40 | Comparative Example |
| 14 | A | 599 | 704 | 85 | 578 | −80 | 578 | 680 | 85 | 0 | Example |
| 15 | B | 555 | 740 | 75 | 551 | −105 | 571 | 714 | 80 | 19 | Example |
| 16 | C | 542 | 733 | 74 | 522 | −100 | 592 | 705 | 84 | 70 | Example |
| 17 | D | 624 | 743 | 84 | 606 | −95 | 616 | 716 | 86 | 10 | Example |
| 18 | E | 612 | 737 | 83 | 589 | −90 | 595 | 708 | 84 | 6 | Example |
| 19 | F | 524 | 759 | 69 | 503 | −110 | 586 | 733 | 80 | 83 | Example |
| 20 | G | 548 | 615 | 89 | 522 | −40 | 461 | 591 | 78 | −61 | Comparative Example |
| 21 | H | 534 | 607 | 88 | 521 | −50 | 458 | 580 | 79 | −63 | Comparative Example |
| 22 | I | 566 | 636 | 89 | 560 | −100 | 491 | 614 | 80 | −69 | Comparative Example |
| 23 | J | 606 | 666 | 91 | 589 | −120 | 533 | 643 | 83 | −55 | Comparative Example |
| 24 | K | 646 | 743 | 87 | 641 | −80 | 576 | 720 | 80 | −66 | Comparative Example |
| 25 | L | 621 | 739 | 84 | 604 | −50 | 589 | 710 | 83 | −15 | Comparative Example |
| 26 | M | 606 | 722 | 84 | 587 | −95 | 588 | 692 | 85 | 2 | Example |
| 27 | A | 525 | 700 | 75 | 502 | −95 | 596 | 674 | 88 | 92 | Example |

*1 Yield strength in a direction at an angle of 30° to the rolling direction

*2 ΔYS = YS of steel pipe − YS of steel sheet in a direction at an angle of 30° to the rolling direction

TABLE 5

| | | Hot Rolling Process | | | | | Cooling Process | | |
|---|---|---|---|---|---|---|---|---|---|
| | | | Roughing Rolling | Finishing Rolling | | | | Inner layer First Cooling | |
| Steel Sheet No. | Steel No. | Heating Heating Temperature (° C.) | Transfer Bar Thickness (mm) | Finishing Delivery Temperature (° C.) | Rolling Reduction*1 (%) | Thickness (mm) | Cooling Start Time (s) | Average Cooling Rate*2 (° C./s) | Cooling Stop Temperature*3 (° C.) |
| 28 | A | 1182 | 56 | 764 | 71 | 16 | 2.8 | 18 | 530 |
| 29 | A | 1078 | 58 | 760 | 72 | 16 | 3.2 | 19 | 543 |
| 30 | A | 1184 | 56 | 784 | 63 | 21 | 5.8 | 14 | 504 |
| 31 | A | 1230 | 60 | 759 | 58 | 25 | 8.0 | 10 | 541 |
| 32 | A | 1192 | 52 | 790 | 62 | 13 | 4.4 | 16 | 513 |
| 33 | A | 1286 | 55 | 784 | 66 | 8 | 4.2 | 20 | 507 |
| 34 | A | 1140 | 50 | 790 | 68 | 16 | 2.4 | 22 | 422 |
| 35 | A | 1194 | 56 | 775 | 71 | 16 | 4.4 | 19 | 622 |
| 36 | A | 1264 | 54 | 792 | 70 | 16 | 4.6 | 18 | 544 |
| 37 | A | 1258 | 56 | 764 | 70 | 17 | 5.0 | 51 | 500 |
| 38 | A | 1248 | 58 | 776 | 67 | 19 | 4.8 | 15 | 516 |
| 39 | A | 1206 | 51 | 804 | 54 | 11 | 3.3 | 21 | 524 |
| 40 | B | 1244 | 56 | 773 | 66 | 14 | 3.6 | 20 | 460 |
| 41 | C | 1208 | 51 | 790 | 63 | 13 | 3.6 | 17 | 523 |
| 42 | D | 1178 | 54 | 791 | 61 | 21 | 5.4 | 13 | 516 |
| 43 | E | 1188 | 54 | 785 | 61 | 21 | 5.0 | 12 | 518 |
| 44 | F | 1220 | 60 | 800 | 63 | 22 | 6.4 | 12 | 497 |
| 45 | G | 1188 | 55 | 780 | 71 | 16 | 4.2 | 19 | 478 |
| 46 | H | 1164 | 51 | 775 | 73 | 14 | 3.0 | 20 | 460 |
| 47 | I | 1232 | 54 | 771 | 61 | 21 | 5.5 | 17 | 503 |
| 48 | J | 1206 | 55 | 797 | 58 | 16 | 4.6 | 22 | 512 |
| 49 | K | 1260 | 56 | 780 | 68 | 18 | 5.1 | 20 | 488 |
| 50 | L | 1142 | 56 | 774 | 71 | 16 | 4.5 | 22 | 491 |
| 51 | M | 1062 | 56 | 788 | 56 | 16 | 4.6 | 17 | 507 |

| | Cooling Process | | | | | | |
|---|---|---|---|---|---|---|---|
| | | Surface Layer First Cooling | | Second Cooling | | | |
| Steel Sheet No. | Ms (° C.) | Average Cooling Rate*4 (° C./s) | Cooling Stop Temperature*5 (° C.) | Average Cooling Rate*6 (° C./s) | Holding Time*7 (s) | Coiling Coiling Temperature*8 (° C.) | Note |
| 28 | 408 | 42 | 436 | 1.0 | 28 | 484 | Example |
| 29 | 408 | 55 | 413 | 1.5 | 26 | 501 | Example |
| 30 | 408 | 54 | 430 | 0.5 | 27 | 470 | Example |
| 31 | 408 | 77 | 414 | 0.5 | 34 | 511 | Example |
| 32 | 408 | 51 | 427 | 0.4*9 | 25 | 494 | Example |
| 33 | 408 | 45 | 407 | 1.5 | 21 | 475 | Example |
| 34 | 408 | 80 | 356 | 2.0 | 24 | 365 | Comparative Example |
| 35 | 408 | 45 | 420 | 1.0 | 28 | 583 | Comparative Example |
| 36 | 408 | 54 | 446 | 3.0 | 26 | 459 | Comparative Example |
| 37 | 408 | 149 | 404 | 1.0 | 28 | 470 | Comparative Example |
| 38 | 408 | 71 | 361 | 1.0 | 28 | 499 | Comparative Example |
| 39 | 408 | 65 | 394 | 0.3*9 | 28 | 496 | Example |
| 40 | 406 | 82 | 412 | 1.5 | 28 | 425 | Example |
| 41 | 392 | 60 | 435 | 1.0 | 28 | 492 | Example |
| 42 | 417 | 64 | 399 | 1.0 | 28 | 478 | Example |
| 43 | 382 | 59 | 425 | 0.5 | 28 | 490 | Example |
| 44 | 393 | 56 | 440 | 1.0 | 28 | 463 | Example |
| 45 | 365 | 63 | 406 | 1.0 | 28 | 452 | Comparative Example |
| 46 | 422 | 58 | 413 | 1.0 | 28 | 428 | Comparative Example |
| 47 | 422 | 65 | 451 | 0.5 | 28 | 480 | Comparative Example |
| 48 | 424 | 59 | 433 | 1.0 | 28 | 474 | Comparative Example |
| 49 | 398 | 60 | 402 | 1.0 | 28 | 455 | Comparative Example |
| 50 | 406 | 54 | 440 | 1.5 | 28 | 461 | Comparative Example |
| 51 | 407 | 49 | 438 | 1.0 | 28 | 479 | Example |

*1 Cumulative rolling reduction (%) in a temperature range of 930° C. or lower

*2 Average cooling rate in a temperature range of 750° C. or lower and 600° C. or higher (temperature of the central part of the thickness)

*3 Temperature of the central part of the thickness derived by heat-transfer calculation

*4 Average cooling rate in a temperature range of 600° C. or lower and 450° C. or higher (surface temperature)

*5 Surface temperature at the time of cooling stop

*6 Average cooling rate from the cooling stop temperature of the first cooling to the coiling temperature (temperature of the central part of the thickness)

*7 Holding time in a temperature range from the cooling stop temperature of the first cooling to the coiling temperature (temperature of the central part of the thickness)

*8 Surface Temperature

*9 Holding for 20 seconds or more

TABLE 6

| | | Surface Layer Microstructure | | | | Second Phase | | | Inner Layer Microstructure | | | |
|---|---|---|---|---|---|---|---|---|---|---|---|---|
| | | | BF | | | Martensite | | | | BF | | |
| Steel Sheet No. | Steel No. | Phase*1 | Fraction (area %) | Average Grain Diameter (μm) | Lath Thickness (μm) | Fraction (area %) | Average Grain Diameter (μm) | Maximum Grain Diameter (μm) | Phase*1 | Fraction (area %) | Average Grain Diameter (μm) | Lath Thickness (μm) |
| 28 | A | BF + TM | 99.5 | 4.6 | 0.33 | 0.5 | 1.1 | 2.4 | BF + M | 95.2 | 6.0 | 0.69 |
| 29 | A | BF + TM | 99.0 | 4.0 | 0.36 | 1.0 | 1.3 | 2.0 | BF + M | 95.6 | 5.3 | 0.70 |
| 30 | A | BF + TM | 99.6 | 4.5 | 0.42 | 0.4 | 1.1 | 2.4 | BF + M | 95.0 | 4.8 | 0.76 |
| 31 | A | BF + TM | 99.7 | 4.1 | 0.45 | 0.3 | 1.0 | 2.5 | BF + M | 95.1 | 5.0 | 0.72 |
| 32 | A | BF + TM | 99.2 | 4.3 | 0.32 | 0.8 | 1.1 | 2.4 | BF + M | 96.5 | 4.8 | 0.61 |
| 33 | A | BF + TM | 99.4 | 4.4 | 0.44 | 0.6 | 1.6 | 3.1 | BF + M | 94.6 | 4.6 | 0.81 |
| 34 | A | BF + TM | 99.5 | 4.5 | 0.29 | 0.5 | 1.3 | 2.5 | BF | 100.0 | 9.2 | 0.56 |
| 35 | A | BF + TM | 99.5 | 5.0 | 0.36 | 0.5 | 1.4 | 2.5 | BF + M | 99.8 | 4.5 | 0.61 |
| 36 | A | BF + TM | 99.5 | 4.3 | 0.40 | 0.5 | 1.4 | 2.4 | BF + M | 96.6 | 5.1 | 0.75 |
| 37 | A | BF + TM | 88.0 | 4.5 | 0.13 | 12.0 | 3.3 | 6.8 | BF + B + M | 95.2 | 4.6 | 0.11 |
| 38 | A | BF + TM | 99.6 | 3.9 | 0.33 | 0.4 | 0.9 | 2.4 | BF + B + M | 94.2 | 4.8 | 0.80 |
| 39 | A | BF + TM | 99.7 | 3.7 | 0.37 | 0.3 | 0.9 | 1.6 | BF + M | 94.8 | 5.0 | 0.66 |
| 40 | B | BF + TM | 99.5 | 3.8 | 0.35 | 0.5 | 0.8 | 2.2 | BF + M | 94.8 | 4.2 | 0.73 |
| 41 | C | BF + TM | 99.7 | 3.3 | 0.34 | 0.3 | 1.1 | 1.8 | BF + M | 95.2 | 4.8 | 0.90 |
| 42 | D | BF + TM | 99.7 | 3.6 | 0.33 | 0.3 | 1.3 | 1.6 | BF + M | 94.6 | 4.0 | 0.80 |
| 43 | E | BF + TM | 99.6 | 3.9 | 0.38 | 0.4 | 1.1 | 2.1 | BF + M | 95.2 | 4.7 | 0.72 |
| 44 | F | BF + TM | 99.7 | 4.2 | 0.36 | 0.3 | 1.1 | 2.0 | BF + M | 94.3 | 5.0 | 0.63 |
| 45 | G | BF + TM | 99.5 | 4.2 | 0.44 | 0.5 | 1.3 | 2.0 | BF + B + M | 74.3 | 4.9 | 0.76 |
| 46 | H | BF + TM | 99.0 | 10.6 | 0.41 | 1.0 | 2.1 | 2.6 | BF + P + M | 88.7 | 5.1 | 0.82 |
| 47 | I | BF + TM | 99.7 | 4.4 | 0.33 | 0.3 | 1.1 | 1.8 | BF + M | 99.3 | 4.9 | 0.65 |
| 48 | J | BF + TM | 99.5 | 3.9 | 0.21 | 0.5 | 1.6 | 2.1 | BF + M | 98.9 | 4.3 | 0.61 |
| 49 | K | BF + TM | 99.5 | 4.2 | 0.36 | 0.5 | 1.0 | 2.2 | BF + M | 96.3 | 4.6 | 0.69 |
| 50 | L | BF + TM | 98.4 | 8.6 | 0.40 | 1.6 | 2.5 | 6.3 | F + BF + M | 96.8 | 12.0 | 0.48 |
| 51 | M | BF + TM | 99.3 | 4.2 | 0.32 | 0.7 | 2.6 | 5.0 | BF + B + M | 94.0 | 4.6 | 0.38 |

| | Inner Layer Microstructure | | | | | | |
|---|---|---|---|---|---|---|---|
| | Second Phase | | | | | | |
| | Massive M | | | | | | |
| Steel Sheet No. | Fraction (area %) | Average Size (μm) | Maximum Size (μm) | Aspect Ratio | Rod-like M Fraction*2 (area %) | Other Phase*1: (area %) | Note |
| 28 | 4.3 | 1.5 | 5.1 | 3.5 | 0.5 | | Example |
| 29 | 3.8 | 1.5 | 4.4 | 3 | 0.6 | | Example |
| 30 | 4.5 | 1.3 | 4.6 | 3.5 | 0.5 | | Example |
| 31 | 4.6 | 1.1 | 6.6 | 3 | 0.3 | | Example |
| 32 | 3.5 | 1.2 | 4.3 | 3 | — | | Example |
| 33 | 3.9 | 1.5 | 4.9 | 3.5 | 1.5 | | Example |
| 34 | 0.0 | — | — | — | — | | Comparative Example |
| 35 | 0.0 | — | — | — | 0.2 | | Comparative Example |
| 36 | 0.3 | 0.6 | 1.5 | 2.5 | 3.1 | | Comparative Example |
| 37 | 2.9 | 1.3 | 3.6 | 3.5 | — | B: 1.9 | Comparative Example |
| 38 | 0.0 | — | — | — | 0.7 | B: 5.8 | Comparative Example |
| 39 | 5.2 | 1.6 | 4.5 | 3 | — | | Example |
| 40 | 4.0 | 1.3 | 3.9 | 2.5 | 1.2 | | Example |
| 41 | 3.9 | 1.4 | 4.0 | 4 | 0.9 | | Example |
| 42 | 4.6 | 1.2 | 4.2 | 3.5 | 0.8 | | Example |
| 43 | 3.7 | 1.3 | 3.2 | 3 | 1.1 | | Example |
| 44 | 5.1 | 1.6 | 5.9 | 3.5 | 0.6 | | Example |
| 45 | 3.6 | 1.1 | 4.9 | 3.5 | 0.1 | B: 22 | Comparative Example |
| 46 | 4.5 | 1.5 | 4.2 | 4 | 0.3 | P: 6.5 | Comparative Example |
| 47 | 0.6 | 0.4 | 4.5 | 3.5 | 0.1 | | Comparative Example |
| 48 | 0.9 | 0.5 | 11.5 | 3.5 | 0.2 | | Comparative Example |
| 49 | 3.4 | 1.3 | 4.2 | 3 | 0.3 | | Comparative Example |
| 50 | 2.2 | 1.6 | 4.8 | 4.5 | 1.0 | F: 2.7% | Comparative Example |
| 51 | 5.0 | 4.3 | 3.8 | 4 | 1.0 | B: 1.3% | Example |

*1 F: ferrite P: pearlite, B: bainite, BF: bainitic ferrite M: martensite, TM: tempered martensite

*2 (amount of martensite having an aspect ratio of 5.0 or more)/(total amount of martensite)

TABLE 7

| Steel | | Tensile Property | | | | Toughness | Pipe Strength | | | Change | |
|---|---|---|---|---|---|---|---|---|---|---|---|
| Sheet No. | Steel No. | YS (MPa) | TS (MPa) | YR (%) | YS30°*1 (MPa) | vTrs (° C.) | YS (MPa) | TS (MPa) | YR (%) | in Strength ΔYS*2 (MPa) | Note |
| 28 | A | 585 | 694 | 84 | 557 | −100 | 585 | 674 | 87 | 28 | Example |
| 29 | A | 590 | 696 | 85 | 566 | −105 | 582 | 669 | 87 | 16 | Example |
| 30 | A | 583 | 701 | 83 | 558 | −90 | 564 | 675 | 84 | 6 | Example |
| 31 | A | 586 | 703 | 83 | 560 | −100 | 576 | 681 | 85 | 16 | Example |
| 32 | A | 568 | 695 | 82 | 576 | −105 | 577 | 667 | 87 | 1 | Example |
| 33 | A | 573 | 712 | 80 | 560 | −95 | 583 | 674 | 86 | 23 | Example |
| 34 | A | 624 | 720 | 87 | 596 | −60 | 563 | 700 | 80 | −33 | Comparative Example |
| 35 | A | 636 | 694 | 92 | 569 | −110 | 546 | 684 | 80 | −23 | Comparative Example |
| 36 | A | 624 | 706 | 88 | 566 | −85 | 545 | 702 | 78 | −21 | Comparative Example |
| 37 | A | 618 | 685 | 90 | 595 | −90 | 567 | 665 | 85 | −28 | Comparative Example |
| 38 | A | 630 | 714 | 88 | 589 | −105 | 558 | 663 | 84 | −31 | Comparative Example |
| 39 | A | 594 | 713 | 83 | 571 | −80 | 590 | 717 | 82 | 19 | Example |
| 40 | B | 589 | 724 | 81 | 560 | −105 | 584 | 703 | 83 | 24 | Example |
| 41 | C | 593 | 715 | 83 | 585 | −110 | 601 | 701 | 86 | 16 | Example |
| 42 | D | 584 | 706 | 83 | 573 | −95 | 578 | 698 | 83 | 5 | Example |
| 43 | E | 581 | 695 | 84 | 557 | −90 | 588 | 694 | 85 | 31 | Example |
| 44 | F | 574 | 699 | 82 | 559 | −100 | 575 | 706 | 81 | 16 | Example |
| 45 | G | 588 | 644 | 91 | 537 | −50 | 490 | 608 | 81 | −47 | Comparative Example |
| 46 | H | 570 | 652 | 87 | 521 | −45 | 452 | 594 | 76 | −69 | Comparative Example |
| 47 | I | 574 | 645 | 89 | 565 | −100 | 516 | 625 | 83 | −49 | Comparative Example |
| 48 | J | 588 | 680 | 86 | 580 | −80 | 553 | 652 | 85 | −27 | Comparative Example |
| 49 | K | 621 | 719 | 86 | 614 | −85 | 584 | 699 | 84 | −30 | Comparative Example |
| 50 | L | 658 | 741 | 89 | 606 | −45 | 579 | 710 | 82 | −27 | Comparative Example |
| 51 | M | 591 | 706 | 84 | 568 | −100 | 580 | 696 | 83 | 12 | Example |

*1 Yield strength in a direction at an angle of 30° to the rolling direction

*2 ΔYS = YS of steel pipe − YS of steel sheet in a direction at an angle of 30° to the rolling direction Examples of the present disclosure were all high strength hot rolled steel sheets with low yield ratio and high toughness having a yield stress in a direction at 30° to the rolling direction of 480 MPa or more, a tensile strength in the width direction of 600 MPa or more, a fracture transition temperature vTrs of −80° C. or lower, and a yield ratio of 85% or less without performing a special heat treatment. On the other hand, in the case of the comparative examples which were out of the ranges according to the present disclosure hot rolled steel sheets having the desired properties were not obtained because of insufficient yield stress, a decrease in tensile strength, a decrease in low-temperature toughness or a low yield ratio not being achieved.

Moreover, the examples of the present disclosure were all hot rolled steel sheets which can be preferably used as a raw material of a spiral steel pipe or an ERW pipe, because there was only a small amount of decrease in strength due to pipe-making even after a pipe-making process has been performed.

Although steel No. 27 satisfied the conditions that YS in a direction at an angle of 30° to the rolling direction is 480 MPa or more, that TS in the thickness direction is 600 MPa or more, that vTrs is −80° C. or lower, and that a yield ratio is 85% or less, since the area fraction of a tempered martensitic phase in the surface layer was more than 2%, ΔYS after pipe-making had been performed was more than 90 MPa.

The invention claimed is:

1. A hot rolled steel sheet having a chemical composition comprising, by mass %:

C: 0.03% or more and 0.10% or less;
Si: 0.01% or more and 0.50% or less;
Mn: 1.4% or more and 2.2% or less;
P: 0.025% or less;
S: 0.005% or less;
Al: 0.005% or more and 0.10% or less;
Nb: 0.02% or more and 0.10% or less;
Ti: 0.001% or more and 0.030% or less;
Mo: 0.01% or more and 0.50% or less;
Cr: 0.01% or more and 0.50% or less;
Ni: 0.01% or more and 0.50% or less; and
the balance being Fe and inevitable impurities,
the hot rolled steel sheet comprising:

a surface layer having a microstructure that includes (i) a bainitic ferrite phase or (ii) the bainitic ferrite phase and a tempered martensitic phase, a lath thickness of the bainitic ferrite phase of the surface layer being 0.2 μm or more and 1.6 μm or less, and an inner layer having a microstructure that includes bainitic ferrite phase as a main phase and, in terms of area fraction, 1.4% or more and 15% or less of a massive martensitic phase having an aspect ratio of less than 5.0 as a second phase, a lath thickness of the bainitic ferrite phase of the inner layer being in a range of 0.2 μm or more and 1.6 μm or less.

2. The hot rolled steel sheet according to claim 1, wherein the chemical composition has an Moeq value in a range of 1.4% or more and 2.2% or less, the Moeq value being defined by the following formula (1), $$\text{Moeq (\%)}=\text{Mo}+0.36\text{Cr}+0.77\text{Mn}+0.07\text{Ni} \quad (1),$$

where Mn, Ni, Cr, and Mo respectively represent the contents of the corresponding chemical elements by mass %.

3. The hot rolled steel sheet according to claim 1, wherein the chemical composition further comprises, by mass %, at least one selected from the group consisting of Cu: 0.50% or less, V: 0.10% or less, and B: 0.0005% or less.

4. The hot rolled steel sheet according to claim 1, wherein the chemical composition further comprises, by mass %, Ca: 0.0005% or more and 0.0050% or less.

5. The hot rolled steel sheet according to claim 1, wherein a maximum grain diameter of the massive martensitic phase is 5.0 μm or less and an average grain diameter of the massive martensitic phase is in a range of 0.5 μm or more and 3.0 μm or less.

6. The hot rolled steel sheet according to claim 1, wherein the surface layer includes the tempered martensitic phase and an average grain diameter of the tempered martensitic phase in the surface layer is 3.0 μm or less and a maximum grain diameter of the tempered martensitic phase in the surface layer is 4.0 μm or less.

7. The hot rolled steel sheet according to claim 1, wherein the surface layer is defined by a region that is within a depth of less than 2 mm in a thickness direction from an upper surface or a lower surface of a steel sheet.

8. The hot rolled steel sheet according to claim 3, wherein the chemical composition further comprises, by mass %, Ca: 0.0005% or more and 0.0050% or less.

* * * * *